US006871035B2

(12) United States Patent
Nakagawa

(10) Patent No.: US 6,871,035 B2
(45) Date of Patent: Mar. 22, 2005

(54) DEVELOPING APPARATUS

(75) Inventor: Ken Nakagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/442,303

(22) Filed: May 21, 2003

(65) Prior Publication Data

US 2003/0219285 A1 Nov. 27, 2003

(30) Foreign Application Priority Data

May 21, 2002 (JP) ..... 2002-146905

(51) Int. Cl.[7] ..... G03G 15/08

(52) U.S. Cl. ..... 399/281; 399/270; 399/272; 399/285

(58) Field of Search ..... 399/270, 272, 399/281, 285, 53, 55; 430/120

(56) References Cited

U.S. PATENT DOCUMENTS

| | | | | |
|---|---|---|---|---|
| 5,027,157 A | * | 6/1991 | Hotomi et al. | 399/281 X |
| 5,247,333 A | | 9/1993 | Yamamoto et al. | 399/273 |
| 5,640,651 A | | 6/1997 | Katoh et al. | 399/119 |
| 5,742,885 A | * | 4/1998 | Wayman | 399/293 |
| 5,850,587 A | * | 12/1998 | Schmidlin | 399/258 |
| 5,887,233 A | | 3/1999 | Abe et al. | 399/284 |
| 5,955,228 A | * | 9/1999 | Sakai et al. | 430/120 X |
| 6,175,697 B1 | * | 1/2001 | Kopp et al. | 399/53 |
| 6,314,257 B1 | | 11/2001 | Ishii et al. | 399/150 |
| 2002/0009305 A1 | | 1/2002 | Uehara | 399/55 |
| 2003/0026629 A1 | | 2/2003 | Kawamura et al. | 399/281 |

FOREIGN PATENT DOCUMENTS

| | | | |
|---|---|---|---|
| JP | 56-123573 | | 9/1981 |
| JP | 56-123574 | | 9/1981 |
| JP | 02-10148 | | 1/1990 |
| JP | 02-101485 | | 4/1990 |
| JP | 04-086774 | * | 3/1992 |
| JP | 06-51623 | | 2/1994 |
| JP | 06-16210 | | 3/1994 |
| JP | 08-179608 | | 7/1996 |

OTHER PUBLICATIONS

Patent Abstracts of Japan, Publication No. 6–51623, Feb. 25, 1994.

* cited by examiner

*Primary Examiner*—Sophia S. Chen
(74) *Attorney, Agent, or Firm*—Fitzpatrick, Cella, Harper & Scinto

(57) ABSTRACT

A developing apparatus includes a developer carrying member for carrying a developer; and a developer feeding member, disposed close to or in contact to the developer carrying member, for supplying a developer to the developer carrying member, the developer feeding member being in the form of a wire and is adapted to be supplied with a voltage which is effective to electrically charge the developer to a regular polarity and which is higher than a discharge starling voltage at which electric discharge starts between the developer carrying member and the developer feeding member.

13 Claims, 10 Drawing Sheets

(a)

(b)

(a)

(b)

DEVELOPING APPARATUS

FIELD OF THE INVENTION AND RELATED ART

The present invention relates to a developing device, preferably a developing device usable with an image forming apparatus such as a monochromatic printer, a color printer, a facsimile or a copying machine, of an electrophotographic type or an electrostatic recording type. A developing device which visualizes an electrostatic latent image with a non-magnetic one component developer is known and is practically used. Referring first to FIG. 19, there is shown a schematic section of an example of a conventional non-magnetic one component developing device. As shown in this Figure, the conventional developing device 4 is provided with a developing container accommodating insulative one-component toner 7 (developer). The toner 7 exhibits a negative chargeability, for example, more particularly, negative chargeability non-magnetic toner comprising pigment or dye of yellow, magenta, cyan or black color.

The developing container 8 has an opening at a position facing to the object to be developed, and a developing roller 5 (developer carrying member) is rotatably supported so as to be partly exposed to outside through the opening.

In the developing container 8, there is provided a developer stirring member (toner stirring member) including plate-like or screw member of a proper shape, and it is rotated in the clockwise direction as indicated by an arrow in the Figure to stir and feed the toner 7 in the developing container 8 toward the developing roller 5, thus establishing a toner supply path. The shapes and the number of the developer stirring members 15 are determined in consideration of the configuration of the developing container 8 such that toner supply path is properly established so as to feed the toner 7 from an end of the developing container 8 to the neighborhood of the developing roller 5.

In a magnetic developing method, the developing roller 5 is given a magnetic force to attract to the developing roller 5 the developer toner (magnetic one-component developer or the like) containing magnetic material. In a non-magnetic one component developing method, the magnetic property of the toner is very weak, and therefore, toner attraction using the magnetic force is difficulty. Therefore, additional means for causing the toner to be carried on the developing roller 5 is required in many cases. As will be described hereinafter, there are other methods. Generally, however, a scraping and supplying roller 13 are contacted to or opposed with a space to the developing roller 5.

The scraping and supplying roller 13 is rotationally driven with a peripheral speed difference relative to the developing roller 5. The rotational direction of the scraping and supplying roller 13 may be the same as or opposite to the rotational direction of the developing roller 5. In any case, by the provision of the peripheral speed difference relative to developing roller 5, the developing roller 5 can be supplied with a proper amount of the toner, and simultaneously, the toner 7 remaining of the developing roller 5 after it passes the position where it is opposed to the image bearing member 1, is scraped.

In the developing container 8, there is provided a partition plate of the developing container 16, and the height thereof is adjusted such that substantially constant amount of the toner 7 supplied from the developer stirring member 15 always is present adjacent developing roller 5 and the scraping and supplying roller 13.

A regulating blade 6 (developer regulating member) is contacted to the developing roller 5. The regulating blade 6 functions to regulate the toner 7 on the developing roller 5 to form a thin layer so as to regulate the thickness of the layer of the toner 7 to be fed to the developing zone. In addition, it functions to triboelectrically charge the toner 7. The regulating blade 6 comprises a thin metal plate of phosphor bronze, stainless steel or the like having a thickness of several hundreds $\mu$m, and a urethane rubber bonded or welded to a free end of the thin metal plate. The regulating blade 6 is uniformly contacted to the developing roller 5 by elasticity of the thin metal plate.

The amount and the charge amount of the toner 7 fed to the developing zone adjacent to the position where the developing roller 5 is faced to the object to be developed, is determined by the contact pressure of the regulating blade 6 relative to the developing roller 5, the width of contact or the like. The contact pressure is determined by the material, thickness, deformation of the thin metal plate, the contact angle relative to the developing roller 5 and the like. Various elements are selected such that feeding amount of the toner 7 onto the developing roller 5 is approx. 0.3–1.0 mg/cm$^2$ per unit area.

The electrophotographic photosensitive member 1 which is an image bearing member to be developed is usually in the form of a drum (photosensitive drum). It is rotated in the clockwise direction indicated by an arrow in FIG. 19, and the toner 7 fed on the developing roller 5 to the developing zone adjacent the position where the developing roller 5 is opposed to the photosensitive drum 1, is deposited to the electrostatic latent image on the photosensitive drum 1, thus visualizing the electrostatic latent image into a toner image.

An example of means for supplying the toner onto the developing roller 5 is disclosed in Japanese Laid-Open Patent Application Hei 6-16210 (the above-mentioned peeling and supplying roller 13). Japanese Laid-Open Patent Application Hei 2-101485 discloses another example wherein the use is made with a rotatable member having a roughened surface which is not contacted to the developing roller 5. Japanese Laid-Open Patent Application Hei 8-179608 discloses a further example which is a rotatable polygonal prism not contacted to the developing roller 5.

With the method using a scraping and supplying roller 13 as disclosed in Japanese Laid-Open Patent Application Hei 6-16210, there is a peripheral speed difference between the developing roller 5 and the scraping and supplying roller 13, with the result that driving torque required by the developing device 4 is large.

With the toner supplying method for the developing roller 5 as disclosed in Japanese Laid-open Patent Application Hei 2-101485 and Japanese Laid-open Patent Application Hei 6-16210, the developer feeding member is out of contact to the developing roller 5, so that during torque of the developing device 4 can be reduced. However, the rotation for the developer feeding member is required, and from the viewpoint of driving various members, the complication is equivalent to the system disclosed in Japanese Laid-Open Patent Application Hei 6-16210. Additionally, the downsizing of the developing device 4 is prevented, because the developer feeding member not contacted to the developing roller 5 and having a certain volume has to be disposed.

SUMMARY OF THE INVENTION

Accordingly, it is a principal object of the present invention to provide a developing device wherein a driving torque is reduced, and the downsizing and cost reduction is accomplished with a simple structure.

It is another object of the present invention to provide a developing device wherein the sliding between the developer carrying member and the developer feeding member is reduced.

It is a further object of the present invention to provide a developing device wherein a load imparted to the developer by the developer feeding member can be decreased.

It is a further object of the present invention to provide a developing device wherein the developer feeding member is in the form of a wire.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A developing apparatus according to an embodiment of the present invention will be described.

Figure 2:
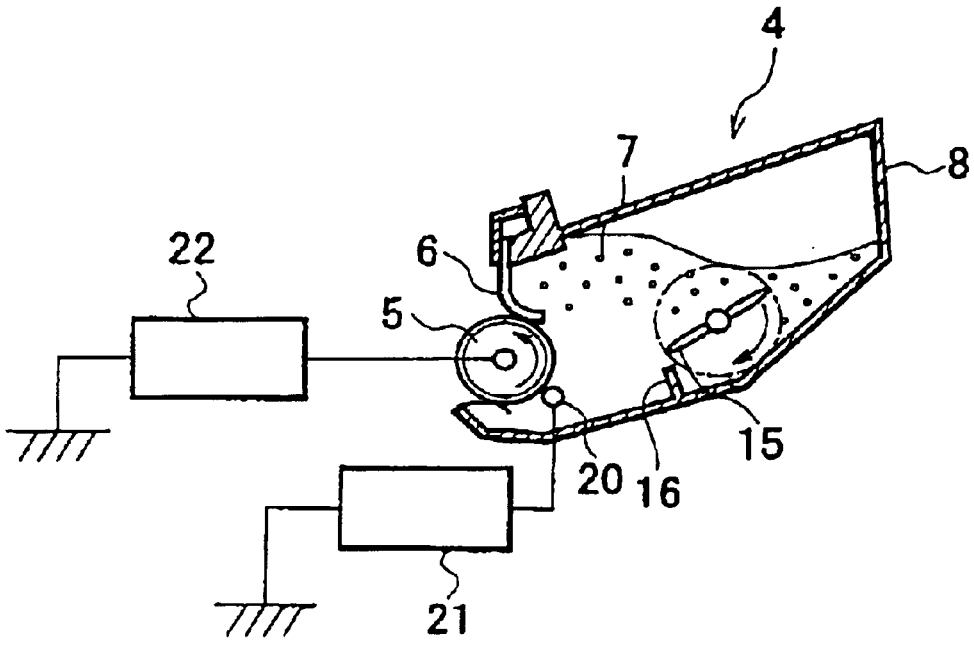
FIG. 2 is a schematic sectional view of a developing device according to an embodiment of the present invention.

FIG. 2 is a schematic sectional view of the developing apparatus 4 in this embodiment. The developing apparatus 4 has a developer container 8 containing a toner 7, which is an insulating nonmagnetic single-component developer. The developer container 8 has an opening which faces the photoconductive drum 1 carrying an object of development, and which extends in the lengthwise direction of the photoconductive drum 1. The developing apparatus 4 has a development roller 5, as a developer bearing member, which is disposed at this opening, being partially exposed from the developer container 8. The developing apparatus 4 also has a toner supplying member (toner supplying electrode) 20, as a developer supplying portion, which is a means for supplying the toner 7 to the development roller 5, and which is on the inward side of the opening, being adjacent to the development roller 5 and extending in the lengthwise direction of the development roller 5.

The developing apparatus 4 also has a developer stirring member 15 in the form of a piece of flat plate, which is disposed within the developer container 8, and which is rotatable in the clockwise direction indicated by an arrow mark in the drawing. The developer stirring member is conveys the toner 7 in the developer container 8 toward the development roller 5; it acts as a part of the toner supply path.

The developer container 8 is provided with a developer container partitioning plate 16, which is disposed within the developer container 8, and the height of which is optimized so that, as the toner 7 is propelled toward the development roller 5 by the developer stirring member 15, roughly the same amount of the toner 7 is constantly present adjacent to the development roller 5 and toner supplying member 20.

In this embodiment, the developer roller 5 is an elastic roller, which is roughly 16 mm in diameter. It comprises a metallic core with a diameter of 8 mm, a layer of electrically conductive rubber coated on the peripheral surface of the metallic core, and an external layer of coating on the peripheral surface of the rubber layer. This rubber layer has a thickness of 4 mm, and a resistivity of $10^5$ Ω·cm. The external layer has a thickness of 30 μm and a resistivity of $10^5$ Ω·cm. The development roller 5 is rotationally driven by the driving means (unshown) of the apparatus main assembly, at a peripheral velocity of 120 mm/sec in the counterclockwise direction indicated by an arrow mark in FIG. 2. As the development roller 5 is rotated, the toner 7 borne on the peripheral surface of the development roller 5 is supplied onto the photoconductive drum 1, bearing the object of development, which is outside the developing apparatus 4.

The development roller 5 is connected to a development bias power source 22 so that an electric field is generated between the development roller 5 and photoconductive drum 1. The bias voltage applied to the development roller 5 by the development bias power source 22 is adjusted so that the toner 7 on the development roller 5 is stripped by the electric field generated between the development roller 5 and photoconductive drum 1, is moved onto the photoconductive drum 1. In this embodiment, the development bias is a DC voltage of −400 V.

In order to form a thin uniform layer of the toner 7 on the peripheral surface of the external layer of the development roller 5 after the placement of the toner 7 thereon, a regulating blade 6, as a member for regulating the thickness of the developer layer, in the form of a piece of roughly ten to several hundred micrometers is disposed in contact with the peripheral surface of the development roller 5 in such a manner that the contact pressure between the development blade 6 and the development roller 5 becomes roughly even across the entire range of the contact.

In this embodiment, the amount by which the toner 7 is conveyed to the development area, that is, the adjacencies of where the distance between the peripheral surfaces of the photoconductive drum 1 and development roller 5 is smallest, is set so that the amount of the toner 7 borne on the development roller per unit area of the peripheral surface of the development roller 5 becomes 0.3–1.0 mg/cm$^2$.

In this embodiment, toner which is inherently negative in electrical polarity is used as the toner 7, and the normal amount of the electrical charge which the toner 7 will hold is in the range of −10 to −100 $\mu$C/g. The preferable average particle diameter of the toner 7 is 5–15 $\mu$m.

The average particle diameter and particle size distribution of the toner are measured in the following manner. First, an interface (product of Nikikaki Co., Ltd.) capable of outputting numeric and volumetric distributions, and a personal computer PC9801 (NEC Co., Ltd.), are connected to Coulter counter TA-II or Coulter Multisizer (produce of Coulter Co., Ltd.). Then, 1% water solution of NaCl is prepared as electrolyte using first class sodium chloride. Then, 0.1–5 ml of surfactant (preferably alkylbenzene sulfonate) as dispersant is added to 100–150 ml of the above described electrolyte, and 2–20 mg of test sample is added to the mixture, The electrolyte, which is suspending the test sample, is subjected to an ultrasonic dispersing device for roughly 1–3 minutes to evenly disperse the test sample in the electrolyte. Then, the numeric and volumetric distributions of the test sample are obtained by counting the number of the toner particles which arc greater in diameter than 2 $\mu$m, and measuring their volumes with the use of, for example, Coulter counter TA-II fitted with a 100 $\mu$m aperture. In this embodiment, the volumetric weight average particle diameter obtained from the volumetric distribution was used as the average particle diameter of the toner.

The preferable material for the toner supplying member 20 is electrically conductive wire; normally, electrically conductive wire which is roughly circular in cross-sectional shape is employed. In this embodiment, tungsten wire is employed. The toner supplying member 20 is extended roughly in parallel to the axial direction of the development roller 5 across the entire toner bearing range of the development roller 5.

As will be described later in more detail, the wire diameter (external diameter) of the toner supplying member 20 is desired to be no more than 2 mm. The diameter of the toner supplying member 20 has only to be large enough to provide the toner supplying member with mechanical strength large enough to withstand the friction between the toner supplying member and toner 7. For example, when the toner supplying member 20 is formed of metallic material, the diameter of the toner supplying member 20 is desired to be no less than 100 $\mu$m, which normally is large enough to prevent the toner supplying member 20 from breaking, even if the toner supplying member 20 is subjected to a tensile force as large as roughly 1 N/cm.

The toner supplying member 20 is disposed so that when there is no toner 7 in the developer container 8, and the development roller 5 is not driven, the toner supplying member 20 remains in contact with, or very close to, the development roller 5. When there is the toner 7 in the developer container 8, the adjacencies of the toner supplying member 20 are filled with the toner 7.

Even when the toner supplying member 20 is in contact with the development roller 5, the contact pressure between them is so small that as soon as the development roller 5 is rotationally driven, the toner supplying member 20 is moved away from the development roller 5 by the toner stream created by the toner 7 adhering to the peripheral surface of the development roller 5. As will be described later in more detail, when there is no toner 7 in the developer container 8; the development roller 5 is not driven; and the toner supplying member is in contact with the development roller 5, the contact pressure per unit of length between the toner supplying member 20 and development roller 5 is desired to be no more than 0.7 N/cm, whereas, when there is no toner 7 in the developer container 8; the development roller 5 is not driven; and a gap is present between the toner supplying member and development roller 5, the gap is desired to be no more than 0.5 mm.

The toner supplying member 20 is connected to a bias power source (toner supply bias power source) 21, as a voltage applying means, from which toner supply bias is applied to the toner supplying member 20 so that at least during development, the voltage difference between the toner supplying member 20 and development roller 5 becomes and remains larger than the electrical discharge starting voltage between the two. The toner supply bias power source 21 applies voltage so that such electrical current that is the same in polarity as the polarity of the toner 7 flows from the toner supplying member 20 to development roller 5. In this embodiment, toner which is negative in inherent electrical polarity is used as the toner 7, and therefore, negative electric current flows from the toner supplying member 20 to the development roller 5. Thus, the toner is normally charged by the toner supplying member 20.

Figure 3:
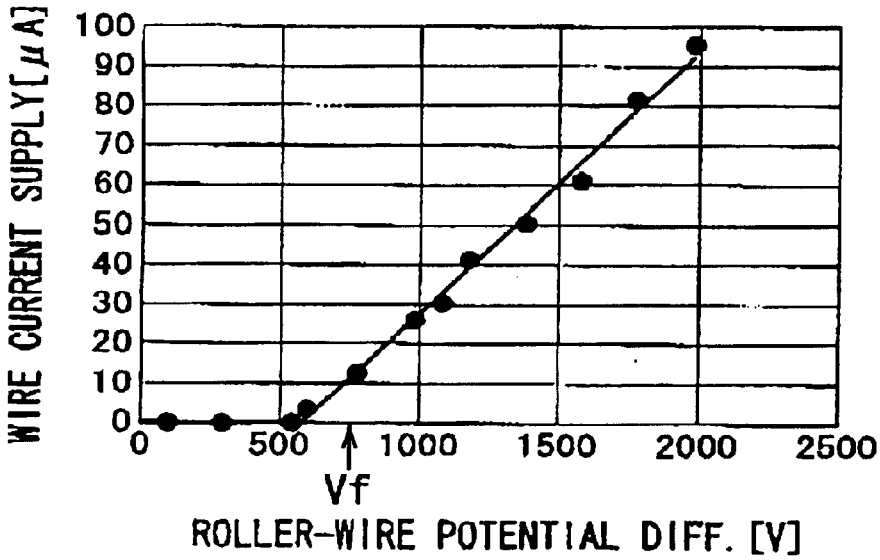
FIG. 3 is a graph showing an example of a relation between the potential difference and the current between the developing roller and the toner supply member.
Figure 4:
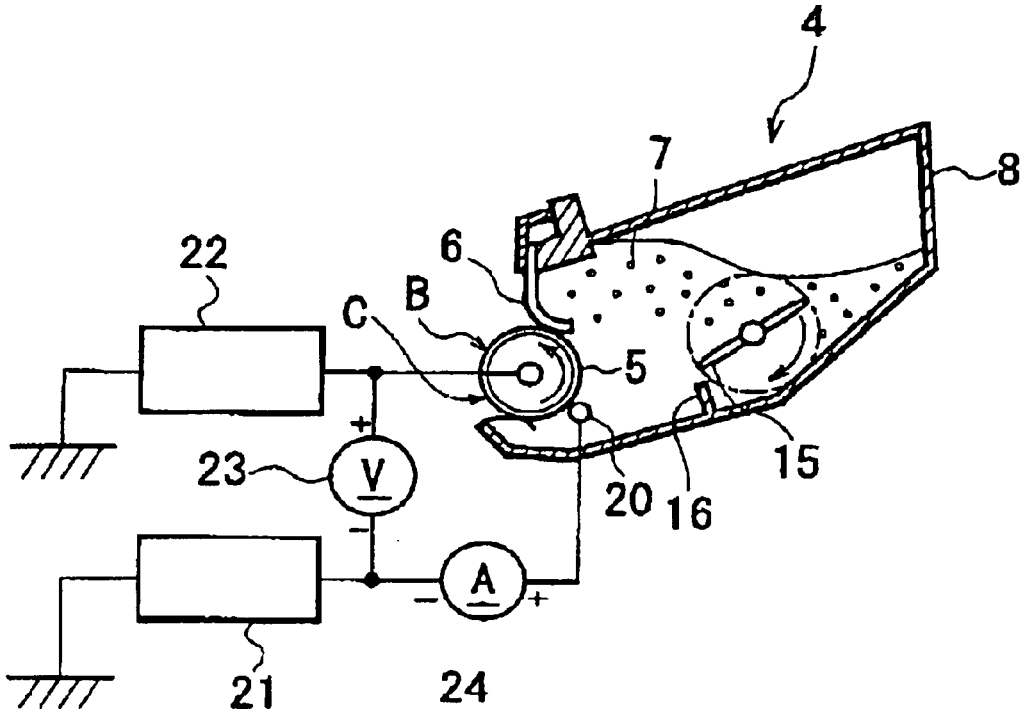
FIG. 4 is a schematic view illustrating a measuring system for the potential difference and the current between the developing roller and the toner supply member.

FIG. 3 shows the results of the measurement of the electric current which flowed through the toner supplying member 20 while the development roller 5 was rotated at the aforementioned peripheral velocity and the voltage applied to the toner supplying member 20 was varied. FIG. 4 shows the system used for the measurement. In the measurement system shown in FIG. 4, the positive side of a voltmeter 23 was connected to the development roller 5, and the negative side was connected to the toner supplying member 20. As for an ammeter 24, the positive side was connected to the toner supplying member 20, and the negative side was connected to the toner supply bias power source 21. Thus, when the value of the electric current in FIG. 3 is positive, it means that the electric current flowed from the development roller 5 to the toner supplying member 20. In this embodiment, toner with the negative normal electrical charge polarity is used, and therefore, the electric current which flows from the toner supplying member 20 to the development roller 5 was the same in electrical charge polarity as the normal electrical charge polarity of the toner 7.

Referring to FIG. 3, the relationship between the potential levels of the development roller 5 and toner supplying member 20 measured by the voltmeter 23 was such that when the difference between the development roller 5 and toner supplying member 20 in terms of the potential level measured by the voltmeter 23 was no less than a certain value, the two potential levels were proportional to each other. Here, this threshold value is defined as the discharge start voltage Vf. More specifically, the discharge start voltage was obtained using the following method. That is, the difference in potential level between the development roller 5 and toner supplying member 20 was measured with the amount of the electric current supplied to the toner supplying member 20 set to several value. Then, an equation which approximates the relationship in potential level between the development roller 5 and toner supplying member 20 was obtained from the results of the measurement. Then, the value of the discharge start voltage was obtained from this equation: the value of the voltage difference at the point at which the line represented by this equation intersects with the axis of abscissa of the graph in FIG. 3 is the discharge start voltage Vf. In this embodiment, the discharge start voltage was roughly 550 V. The value of the discharge start voltage is affected by the material for the toner, the material of the surface layer of the toner supplying member 20, the distance between the toner supplying member 20 and development roller 5, etc. Generally, however, it is in the range of 100–1,500 V.

In this embodiment, the following study was made in order to analyze the consumption of the toner 7 on the development roller 5, and the toner delivery by the toner supplying member 20. In this study, in order to observe the state of the coating of the toner 7 on the development roller 5, on the upstream side of the exposed portion of the development roller 5 in terms of the rotational direction of the development roller 5, the toner 7 on the peripheral surface of the development roller 5 was suctioned by a vacuum cleaner, across the entire range (in terms of axial direction), at the area (area pointed by an arrow mark C in FIG. 4) in which the development roller 5 is exposed from the developer container 8, and which is on the downstream side of the exposed portion of the development roller 5 in terms of the rotational direction thereof, while varying the electrical potential level difference by varying the amount of the electric current supplied to the toner supplying member 20, measured with the use of the measuring system shown in FIG. 4.

When the electric current value was virtually 0 $\mu$A, as the toner 7 on the development roller 5 was suctioned, as described above, the amount of the toner 7 on the development roller 5 was definitely smaller starting the second rotation of the development roller 5, and further, while a given portion of the peripheral surface of the development roller 5 passed the inside of the developer container 8, it was barely coated with the toner 7; the amount of the toner 7 supplied to the development roller 5 in the developer container 8 was not large enough to compensate for the amount of the toner 7 lost by the suction.

When the amount of the electrical potential level difference was set to the discharge start voltage Vf, which caused the discharge current to flow by a small amount, the peripheral surface of the development roller 5 was partially supplied with the toner 7 even during the second rotation of the development roller 5 and thereafter.

When the amount of the electrical potential level difference was further increased to stabilize the amount of the discharge current, the entirety of the peripheral surface of the development roller 5 was supplied with the toner 7.

Figure 5:
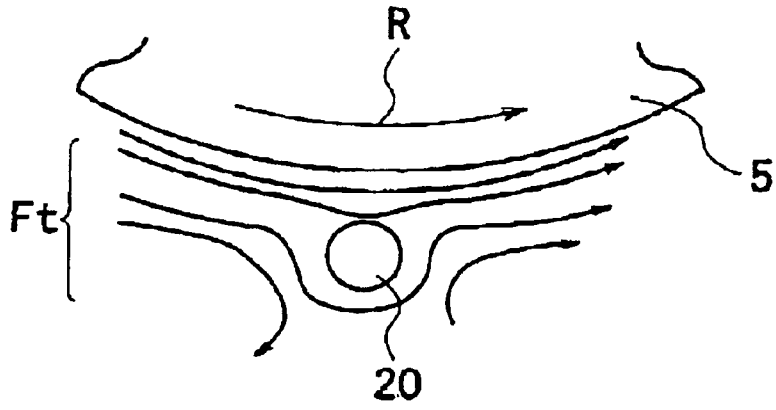
FIG. 5 is a schematic sectional view illustrating an operation of the toner supply member.

FIG. 5 is a schematic drawing showing the flow of the toner 7 in the adjacencies of the toner supplying member 20 while the toner supply bias is not applied. In this embodiment, the developing apparatus 4 is structured so that when there is no toner in the developer container 8 and the development roller 5 is not rotated, the toner supplying member 20 remains very close to, or in contact with, the development roller 5.

As the development roller 5 begins to be rotated in the direction indicated by an arrow mark R in the drawing, the toner 7 begins to gradually adhere to the surface layer of the development roller 5, generating the toner stream Ft, along the peripheral surface of the development roller 5. Thus, the toner supplying member 20 is pushed away by the toner stream Ft from the development roller 5. Consequently, a gap is created between the development roller 5 and toner supplying member 20, and a part of the toner stream Ft (toner 7) flows through this gap.

When the toner supplying member 20 is formed of electrically insulating material such as nylon thread, or there is no difference in potential level between the toner supplying member 20 and development roller 5, as the toner 7 on the development roller 5 is consumed, that is, as the toner 7 on the development roller 5 moves to the photoconductive drum 1 bearing the object of development (above described stripping of toner by suction mimics toner consumption), there will eventually be no toner 7 on the peripheral surface of the development roller 5. As a result, the toner density of the toner stream becomes substantially lower, suddenly weakening the toner stream Ft (flow of toner 7). Thereafter, however, roughly during the second to fifth rotation of the development roller 5 after the formation of the low density toner stream, the gradual adhesion of the toner 7 to the peripheral surface of the development roller 5 is triggered by the incidental contact between the toner 7 and the peripheral surface of the development roller 5, eventually recreating the toner stream Ft.

In other words, once the toner 7 on the peripheral surface of the development roller 5 is entirely consumed, the development roller 5 must be rotated several times until the toner layer is formed again on the peripheral surface of the development roller 5. Thus, the development roller 5 fails to be continuously supplied with the toner 7.

Figure 6:
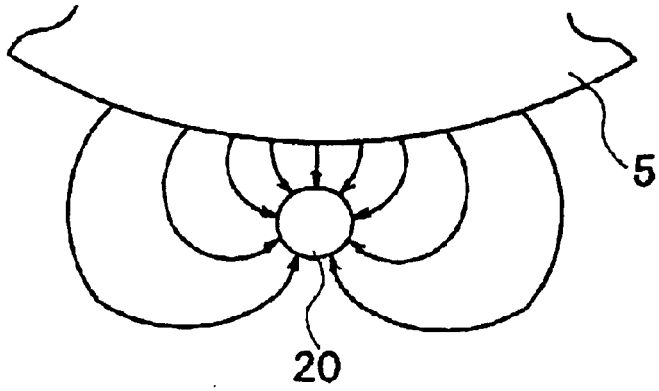
FIG. 6 is a schematic sectional view illustrating an operation of the toner supply member.

In comparison, FIG. 6 shows the direction in which electrical force works when a different in electrical potential level is provided between the toner supplying member 20 and development roller 5. With the presence of a difference in potential level between the toner supplying member 20 and development roller 5, the toner 7 is subjected to the force generated by the electric field generated by the potential level difference. In this embodiment, toner which is negative in normal charge polarity is used. Therefore, the toner 7 is subjected to such force which acts in the direction opposite to the direction (indicated by arrow mark in FIG. 6) in which the electrical force acts, that is, the direction in which the toner 7 is supplied toward the development roller 5.

However, even when the toner 7 is inherently negatively chargeable, the toner 7 is relatively small in the average amount of electrical charge it carries, unless the toner 7 is charged with the use of some means. For this reason, when the potential level difference is smaller than the discharge start voltage, the amount of the toner 7 which is subjected to the force generated by the electric field created between the toner supplying member 20 and development roller 5 is small. Thus, the overall toner supply performance is only slightly better. That is, compared to the number of times (three times) by which the development roller 5 had to be rotated to restore the condition of the toner layer on the development roller 5 to the desirable condition after the consumption of virtually the entirety of the toner 7 on the development roller 5 when no potential level difference was provided between the toner supplying member 20 and development roller 5, the number of times by which the development roller 5 had to be rotated to restore the condition of the toner layer on the development roller 5 to the desirable condition after the consumption of virtually the entirety of the toner 7 on the development roller 5 when a potential level difference of no more than the discharge start voltage was provided between the toner supplying member 20 and development roller 5, was two times. Therefore, the development roller 5 still failed to be continuously supplied with a desirable amount of the toner 7.

When the potential level difference was made greater than the discharge start voltage Vf, the negative electric current constantly flowed from the toner supplying member 20 to the development roller 5. Consequently, the amount by which the toner 7 was supplied to the development roller 5 was much better than otherwise. In other words, as the toner 7 on the development roller 5 was consumed by a given amount, the development roller 5 was immediately supplied with the compensatory amount of the toner 7; a desirable amount of the toner 7 was always present on the peripheral surface of the development roller 5.

It is possible to think that the mechanism which causes negative electric current to flow from the toner supplying member 20 to the development roller 5 is as follows. That is, as the potential level difference between the toner supplying member 20 and development roller 9 is increased to a value greater than the discharge start voltage between the toner supplying member 20 and development roller 5, the gaseous molecules in the air within the toner layer between the development roller 5 and toner supplying member 20 are ionized by the strong electric field formed in the adjacencies of the toner supply member 20 which is relatively small in radius. Then, the resultant positively charged ions collide with the toner supplying member 20 and lose their electric charge, whereas the negatively charged ions transfer to the development roller 5. Some of the negatively charged ions immediately collide with the toner 7, negatively charging the toner 7. However, the negatively charged ions, which do not collide with the toner 7 reach the development roller 5, immediately losing thereby their electric charge. Consequently, the negative electric current flows from the toner supplying member 20 to the development roller 5.

The reason why the amount of the toner 7 supplied to the development roller 5 suddenly increases is thought to be as follows. That is, the ratio of the charged toner particles is suddenly increased by the electric discharge, in the adjacencies of the toner supplying member 20, and the pressure which works in the direction to move the toner 7 is suddenly increased by the electric field between the development roller 5 and toner supplying member 20, causing the toner 7 to flow toward the development roller 5 by a substantially larger amount. Consequently, the amount of the toner 7 supplied to the development roller 5 suddenly increases.

Figure 7:
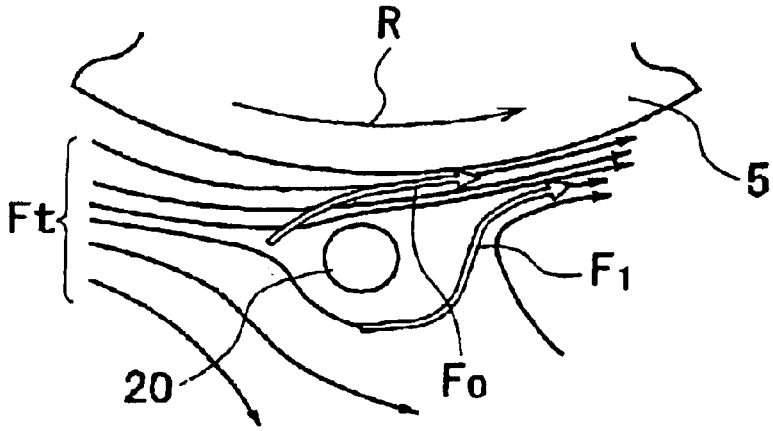
FIG. 7 is a schematic sectional view illustrating an operation of the toner supply member.

To describe in more concrete terms, FIG. 7 schematically shows the flow of the toner 7 when a difference in electrical potential level higher than the discharge start voltage Vf is provided between the development roller 5 and toner supplying member 20. As described above, when the adjacencies of the toner supplying member 20 are in the condition shown in FIG. 7, the toner 7 in the adjacencies of the toner supplying member 20 is charged, being therefore pressured upon the development roller 5. Thus, even if a toner stream with a lower toner density is formed along the peripheral surface of the development roller 5 as the result of the consumption of the toner 7 on the peripheral surface of the development roller 5, a toner stream F0 is immediately generated by the charged toner 7, and then, the toner stream F1 is generated on the downstream side of the toner supplying member 20. With the formation of these toner streams F0 and F1, the force which works in the direction to move the toner 7 toward the development roller 5 increases, making it possible for the toner 7 to be continuously supplied to the development roller 5.

As described above, in order for the toner 7 to be continuously supplied, by a proper amount, to the development roller 5 by the toner supplying member 20, the following two requirements must be satisfied:

(1) The toner 7 in the adjacencies of the toner supplying member 20 is properly charged, and (2) An electric field of a proper magnitude, which works in the direction to move the charged toner 7 toward the development roller 5, is generated. In other words, the toner 7 can be continuously supplied, by a proper amount, to the development roller 5 by supplying the toner supply bias, with the use of the toner supply bias power source 21, so that the potential level difference greater than the discharge start voltage between the toner supplying member 20 and development roller 5 is created between the toner supplying member 20 and development roller 5, and also so that such electric current that is the same in polarity as the charge polarity of the toner 7 flows from the toner supplying member 20 to the development roller 5.

Although this embodiment is described with reference to a case in which toner, the normal electrical polarity of which is negative is used, the present invention is also compatible with a case in which toner, the normal electrical polarity of which is positive, is used. That is, all that is necessary when toner, the normal electrical polarity or which is positive, is used, is to provide such electric potential level difference between the toner supplying member 20 and development roller 5 that the toner supplying member 20 and development roller 5 are reversed in electrical polarity, in other words, the toner supplying member 20 is on the positive side relative to the development roller 5 in terms of electrical polarity. Also when toner with the positive normal electrical polarity is used, there is such a discharge start voltage as there is when toner with the negative normal electrical polarity is used. Thus, as long as the difference in potential level between the toner supplying member 20 and development roller 5 is made greater than this discharge start voltage, electric current flows from the toner supplying member 20 to the development roller 5, making it possible for the toner to be continuously supplied to the development roller 5.

As long as the difference in potential level between the toner supplying member 20 and development roller 5 is greater than the discharge start voltage between the toner supplying member 20 and development roller 5, it is effective to supply the development roller 5 with the toner. However, if it is greater than a certain value, the toner is charged too much by the increased amount of the discharge current, making the toner excessive in mirror force. Consequently, the highly charged toner particles which are not suitable for development increases. In other words, it is undesirable to make the potential level difference between the toner supplying member 20 and development roller 5 greater than a certain value. The further analyses by the inventors of the present invention revealed that this difference in potential level is desired to be no more than (discharge start voltage Vf+1,500 V), preferably, no more than (discharge start voltage Vf+1,000 V), or most preferably, no more than (discharge start voltage Vf+500 V). Further, when this difference in potential level is close to the discharge start voltage, the resultant electric discharge is unstable. Thus, for the purpose of causing stable electric discharge, the difference in potential level is desired to be no less than (discharge start voltage Vf+50 V), most preferably, no less than (discharge start voltage+100 V). In terms of the electric current which flows between the toner supplying member 20 and development roller 5, when the peripheral velocity of the developer bearing member is 120 mm/sec, the amount of the current is normally in the range of 1–20.0 $\mu$A. If the peripheral velocity of the developer bearing member is increased, the amount of the electric current needs to be increased in proportion to the increased peripheral velocity.

In consideration of the fact that the toner is charged by the electric discharge caused by the difference in potential level between the toner supplying member 20 and development roller 5, and also, the fact that the toner streams F0 and F1 which supply the development roller 5 with the toner 7 are formed by the toner 7 charged by the electric field generated by the difference in potential between the toner supplying member 20 and development roller 5, the difference in potential level between the toner supplying member 20 and development roller 5 is desired to be such a difference in potential level that generates direct electric current. However, the present invention does not limit the difference in potential level between the toner supplying member 20 and development roller 5 to DC voltage. That is, the bias voltage applied to the toner supplying member 20 may be a combination of DC voltage and AC voltage as long as the DC component of the bias voltage is no less than the discharge start voltage Vf the application of the combination of DC and AC voltages does not substantially affect the effectiveness with which the toner is supplied to the development roller 5. Thus, for example, when a jumping type developing apparatus, which is well-known among the people in the field of this business, that is, a developing apparatus in which the development roller 5, for example, as a developer bearing member, and the photoconductive drum 1 are disposed with the presence of a gap between them, and developer is made to jump between the development roller 5 and photoconductive drum 1 for development, by applying AC voltage to the development roller 5, and applying to the toner supplying member 20 such a DC voltage that is greater in potential level than the discharge start voltage Vf, as the toner supplying voltage, AC voltage may be applied in addition to DC voltage as necessary.

Hereinafter, the effects of the present invention will be described in detail with reference to several concrete examples. The developing apparatuses 4 in all of the concrete examples are the same in basic structure and operation.

CONCRETE EXAMPLE 1

The toner supplying member 20 was formed of a piece of tungsten wire, the cross section of which was roughly in the form of a circle with a diameter of 0.25 mm. It was disposed adjacent to the development roller 5 with the provision of a gap of 0.5 mm.

As for developer, nonmagnetic single-component developer (toner 7) was used. The average particle diameter of the toner 7 was 7 $\mu$m, and the normal electric charge polarity was negative. The toner 7 was placed in the developer container 8 by an amount large enough to fill the adjacencies of the toner supplying member 20.

Figure 1:
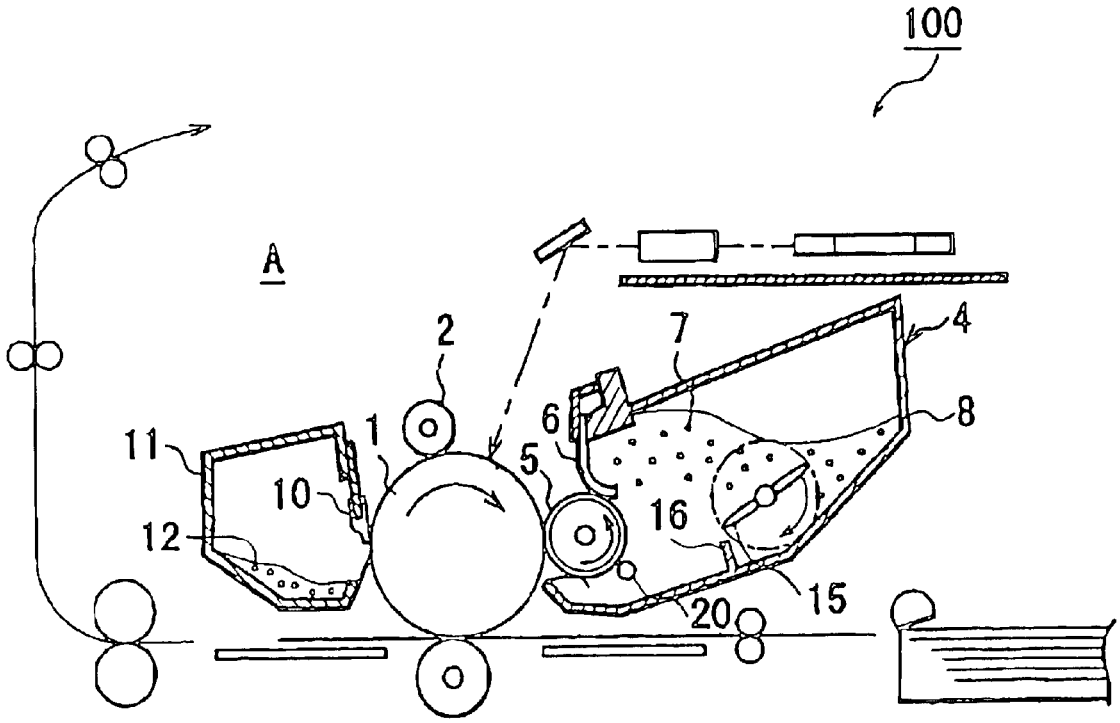
FIG. 1 is a schematic sectional view of an image forming apparatus according to an embodiment of the present invention.

The developing apparatus 4 having the above described developer container 8 was mounted in the image forming apparatus 100 shown in FIG. 1. The difference in potential level between the development roller 5 and toner supplying member 20 during development was set to 800 V, and 20 $\mu$A of electric current was flowed from the development roller 5 to toner supplying member 20. In the test, a solid image (solid image which covers the entirety of recording medium) was consecutively printed on 10 printing papers as recording mediums P. Then, the difference in density between the leading and trailing edge portions, in terms of the direction in which the recording medium P was conveyed, were studied. The results were that no significant difference in density was found between the leading and trailing edge portions in any of 10 copies, and that no significant difference in density was found between the first and tenth copies.

Thus, it was thought that the streams of the toner 7 were generated in the adjacencies of the toner supplying member 20 in the developing apparatus 4 in this example, as schematically shown in FIG. 7.

CONCRETE EXAMPLE 2

The toner supplying member 20 was formed of a piece of tungsten wire, the cross section of which was roughly in the form of a circle with a diameter of 3 mm. It was disposed adjacent to the development roller 5 with the provision of a gap of 200 $\mu$m.

As for developer, the same toner as the toner 7 used in Concrete Example 1 was placed in the developer container 8 by an amount large enough to fill the adjacencies of the toner supplying member 20. The developing apparatus 4 having the above described developer container 8 was mounted in the image forming apparatus 100 shown in FIG. 1. The difference in potential level between the development roller 5 and toner supplying member 20 during development was set to 1,200 V, and 30 $\mu$A of electric current was flowed from the development roller 5 to toner supplying member 20. Then, a solid image was printed on recording paper as the recording medium P.

Figure 11:
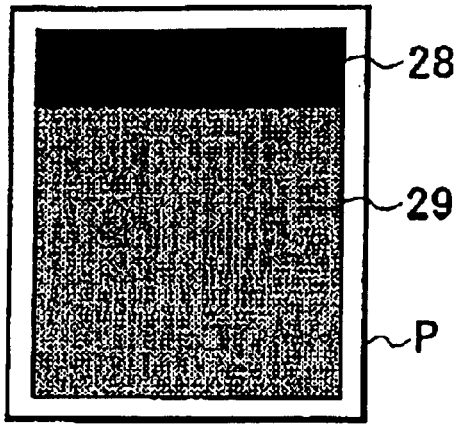
FIG. 11 illustrates an image defect.

As a result, nonuniform images such as the image shown in FIG. 11 were formed. More specifically, the first region 28, that is, the leading edge portion, of the image, which corresponds to the first rotation of the development roller 5 became different in density from the second region 29, that is, the trailing edge side, of the image. This difference in density was thought to have occurred for the following reason. That is, the toner 7 on the development roller 5 was consumed for the development of the first region 28, and as a result, the amount by which the toner 7 was supplied to the development roller 5 for the development of the second region 29 was slightly reduced.

When the difference in potential level between the development roller 5 and toner supplying member 20 was set to 0 V, the density of the second region 29 became very low and nonuniform. Thus, the following presumption was made. That is, even in the case of the structure in this example, the electric discharge from the toner supplying member 20 had some effect on the process of supplying the toner 7 to the development roller 5. However, the effect was not large enough to cause the toner 7 to flow in a manner to supply the development roller 5 with the toner 7. As a result, the toner 7 was supplied to the development roller 5 by a smaller amount.

Figure 8:
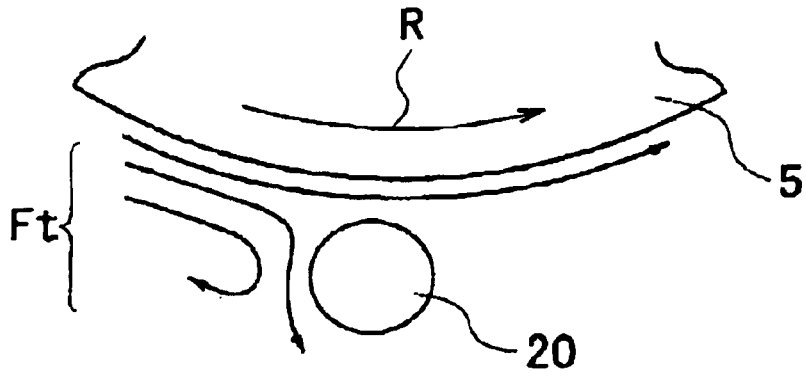
FIG. 8 is a schematic sectional view illustrating an operation of the toner supply member.

FIG. 8 schematically shows the stream of the toner 7 in the adjacencies of the toner supplying member 20, the diameter of which was no less than 3 mm. As will be evident from FIG. 8, the toner 7 on the development roller 5 created the toner stream Ft, a part of which flowed through the gap between the toner supplying member 20 and development roller 5. However, the greater the distance from the development roller 5, the weaker the stream. Thus, at the location of the toner supplying member 20, which was 200 $\mu$m away from the development roller 5, the toner stream Ft was rather weak, being therefore blocked by the toner supplying member 20. In other words, it was thought that unlike the toner stream Ft shown in FIG. 7, the toner stream Ft in FIG. 8 failed to flow over the toner supplying member 20.

More specifically, in the case of the toner stream in FIG. 7, the direction in which the force generated by the electric field acted on the toner 7 was the same as the direction in which the toner stream flowed. Therefore, the toner stream flowed over the toner supplying member 20, and created the toner stream F1, which supplied the development roller 5 with toner 7. In comparison, in this concrete example in which the toner supplying member 20 had a relatively large wire diameter of 3 mm, the toner stream Ft failed to create the above described toner stream F1. Therefore, this example was lower in toner supplying performance.

When a developer supplying member, the diameter of which is no less than 3 mm, is used, and no bias is applied to the developer supplying member, it is necessary to devise a means for rotating the developer supplying means to generate toner streams around the developer supplying means, or to provide a developing apparatus with an area in which toner is held to increase powder pressure, that is, the toner supplying pressure, as disclosed in Japanese Laid-Open Patent Application Hei 6-16210, Japanese Laid-open Patent Application Hei 2-10148, or Japanese Laid-open Patent Application Hei 8-179608.

CONCRETE EXAMPLE 3

The toner supplying member 20 was formed of a piece of tungsten wire, the cross section of which was roughly in the form of a circle with a diameter of 2 mm. It was disposed adjacent to the development roller 5 with the provision of a gap of 200 $\mu$m.

As for developer, the same toner as the toner used in Concrete Example 1, was placed in the developer container 8 by an amount large enough to fill the adjacencies of the toner supplying member 20. Then, the developing apparatus 4 having the above described developer container 8 was mounted in the image forming apparatus 100 shown in FIG. 1. The difference in potential level between the development roller 5 and toner supplying member 20 during development was set to 1,200 V and 30 $\mu$A of electric current was flowed from the development roller 5 to toner supplying member 20. In operation, a solid image (solid image which covers the entirety of recording medium) was consecutively printed on 10 printing papers as recording mediums P. Then, the difference in density between the leading and trailing edge portions of each image, in terms of the direction in which the recording medium P was conveyed, were studied. As a result, no significant difference in density was found between the leading and trailing edge portions in any of 10 copies, and no significant difference in density was found between the first and tenth copies.

The proper wire diameter of the toner supplying member 20 for allowing the toner 7 to form a toner stream strong enough to flow over the toner supplying member 20 is related to the toner particle diameter or the diameter of the toner agglomerate. The analyses by the inventors of the present invention revealed that the proper wire diameter of the toner supplying member 20 was roughly 5–1,000 times the toner particle diameter or the toner agglomerate diameter. Normally, the value of such a wire diameter is no more than 2 mm. Therefore, when the wire diameter of the toner supplying member 20 is no less than 3 mm as is in Concrete Example 2, the toner supplying performance is problematically low.

As is evident from the results of Concrete Examples 1–3, the toner supplying stream F1 (FIG. 7) formed by the synergy between the effect of the toner stream capable of flowing over the toner supplying member 20 and the effect of the above described electric field, made it possible to keep the development roller 5 provided with a proper amount of toner even while the developing apparatus 4 was continuously operated. Thus, the wire diameter of the toner supplying member 20 is desired to be no more than 2 mm, preferably, no more than 1 mm, and most preferably, no more than 0.3 mm.

CONCRETE EXAMPLE 4

The toner supplying member 20 was formed of a piece of tungsten wire, the cross section of which was roughly in the form of a circle with a diameter of 1 mm. It was disposed in contact with the development roller 5 with the provision of a contact pressure (pressure per unit of length) of 1 N/cm.

To describe a method for measuring the contact pressure per unit of length, three one centimeter wide pieces of thin plate, the friction coefficient of which is known are inserted in layers between the development roller 5 and toner supplying member 20 in contact therewith. Then, only the center piece is pulled out by pulling the spring scale attached thereto. Then, the contact pressure per unit of length is calculated from the force necessary to pull out the center piece, and the known friction coefficient.

As for developer, the same toner as the toner used in Concrete Example 1, was placed in the developer container 8 by an amount large enough to fill the adjacencies of the toner supplying member 20. Then, the developing apparatus 4 having the above described developer container 8 was mounted in the image forming apparatus 100 shown in FIG. 1. The difference in potential level between the development roller 5 and toner supplying member 20 during development was set to 400 V and 20 $\mu$A of electric current was flowed from the development roller 5 to toner supplying member 20. In this embodiment, the development roller 5 and toner supplying member 20 were kept in contact with each other even while the developing apparatus 4 was in operation. Therefore, the concept of discharge start voltage does not apply here. Thus, electric current flowed as long as the development roller 5 was different in potential level from the toner supplying member 20. As for the test, a solid image (solid image which covers the entirety of recording medium) was printed on printing paper as recording medium P.

Figure 12:
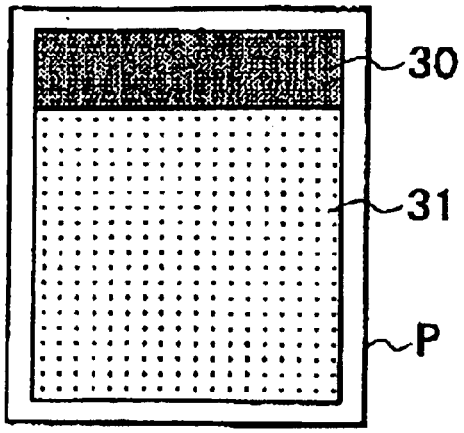
FIG. 12 illustrates an image defect.

As a result, nonuniform images such as the image shown in FIG. 12 were formed. More specifically, the first region 30, that is, the portion of the image adjacent to the leading edge, which corresponds to the first rotation of the development roller 5 came out low in density (desired density could not be realized). Further, the second region 31, that is, the trailing edge side, of the image was slightly lower in density than the first region 30, creating a slight difference in density between the leading and trailing portions of the image.

This difference in density was thought to have occurred for the following reason. That is, the toner 7 on the development roller 5 was stripped by the toner supplying member 20, substantially reducing the amount by which the toner 7 was supplied to the development roller 5 from the beginning of the formation of each image. When the difference in potential level between the development roller 5 and toner supplying member 20 was reduced to 0 V, the density of the second region 31 became extremely low, and that of the first region 30 also became lower, while the amount of the density difference between the leading and trailing portions increased.

Figure 9:
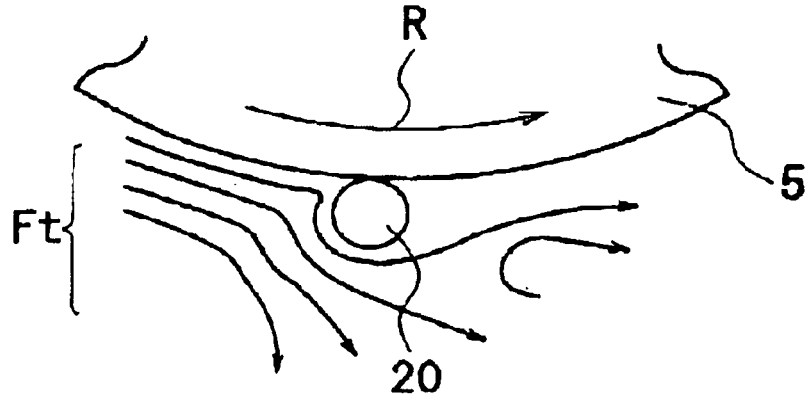
FIG. 9 is a schematic sectional view Illustrating an operation of the toner supply member.

FIG. 9 schematically shows the flow of the toner 7 in the adjacencies of the toner supplying member 20. As shown in FIG. 9, the contact pressure between the development roller 5 and toner supplying member 20 was relatively high. Therefore, even if the development roller 5 was rotated, it was difficult for the toner 7 to flow through the contact area between the development roller 5 and toner supplying member 20. As a result, the toner 7 on the development roller 5 was stripped from the development roller 5.

If the external diameter of the toner supplying member 20 is no more than 2 mm, such a toner stream that is strong enough to flow over the toner supplying member 20 is generated. However, when the toner supplying member 20 is disposed as is the tuner supplying member 20 in this embodiment, the toner 7 is prevented from entering the area between the development roller 5 and toner supplying member 20, that is, the area where the electric field is strongest and the toner supplying pressure is highest. Therefore, the toner stream F0 in the toner 7, which supplies the development roller 5 with the toner 7 is not formed. Thus, the development roller 5 is supplied with the toner 7 mainly by the toner stream F1 created on the downstream side of the toner supplying member 20 by the toner 7 which flows over the toner supplying member 20. As a result, the toner layer on the development roller 5, which is low in toner density, fails to be supplied with a sufficient amount of the toner 7.

CONCRETE EXAMPLE 5

The toner supplying member 20 was formed of a piece of tungsten wire, the cross section of which was roughly in the form of a circle with a diameter of 3 mm. It was disposed in contact with the development roller 5 with the provision of a contact pressure (contact pressure per unit of length) of 1 N/cm. The difference in potential between the development roller 5 and toner supplying member 20 was set to 0 V.

Figure 10:
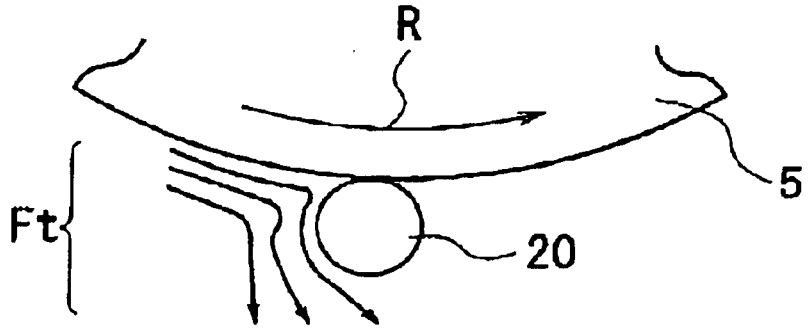
FIG. 10 is a schematic sectional view illustrating an operation of the toner supply member.

As for developer, the same toner as the toner used in Concrete Example 1, was placed in the developer container 8 by an amount not large enough to fill the adjacencies of the toner supplying member 20. Then, the development roller 5 was coated in advance with the toner 7. In this case, the toner stream in the adjacencies of the toner supplying member 20 flowed as shown in FIG. 10.

In this case, the contact pressure between the development roller 5 and toner supplying member 20 was relatively high. Therefore, the major portion of the toner 7 on the development roller 5 failed to flow through the contact area between the development roller 5 and toner supplying member 20. In other words, the major portion of the toner 7 on the development roller 5 was stripped from the development roller 5.

Further, the adjacencies of the toner supplying member 20 was not full of the toner 7. Therefore, the stripped toner 7 freely fell. Thus, one or two rotations of the development roller 5 eliminated virtually the entirety of the toner 7 on the development roller 5. Needless to say, the development roller 5 failed to be supplied with the toner 7.

CONCRETE EXAMPLE 6

The toner supplying member 20 was formed of a piece of relatively thin tungsten wire, the cross section of which was roughly in the form of a circle with a diameter of 0.3 mm. It was disposed in contact with the development roller 5 with the presence of a relatively high contact pressure (contact pressure per unit of length) of 1 N/cm. The difference in potential between the development roller 5 and toner supplying member 20 was set to 0 V.

As for developer, the same toner as the toner used in Concrete Example 1, was placed in the developer container 8 by a smaller amount, that is, an amount not large enough to fill the adjacencies of the toner supplying member 20. Then, the development roller 5 was coated in advance with the toner 7. In this case, the toner stream in the adjacencies of the toner supplying member 20 flowed as will be described next.

In this case, the toner 7 stripped from the development roller 5 flowed over the toner supplying member 20, and formed a foggy stream of the toner 7, which eventually freely fell and settled. Thus, two to three rotations of the development roller 5 eliminated virtually the entirety of the toner 7 on the development roller 5.

This was the result of the stripping effect of the toner supplying member 20 such as the one disclosed Japanese Laid-open Application Hei 6-51623. That is, even if the toner supplying member 20 is formed of electrically insulating wire as disclosed in the above mentioned laid-open application, the toner supplying member 20 strips the toner 7 as does a toner supplying member formed of electrically conductive material. In such a case, the development roller 5 is not supplied with the toner 7 after the stripping of the toner 7 therefrom. Therefore, it is necessary to provide a toner supplying roller as an additional developer supplying member, in addition to the toner supplying member 20.

CONCRETE EXAMPLE 7

The toner supplying member 20 was formed of a piece of tungsten wire, the cross section of which was roughly in the form of a circle with a diameter of 1 mm. It was disposed in contact with the development roller 5 with the provision of a contact pressure (contact pressure per unit of length) of 0.5 N/cm. The method used for measuring the contact pressure per unit of length was the same as that used in the above described Concrete Example 2.

As for developer, the same toner as the toner used in Concrete Example 1, was placed in the developer container 8 by an amount large enough to fill the adjacencies of the toner supplying member 20. Then, the developing apparatus 4 having the above described developer container 8 was mounted in the image forming apparatus 100 shown in FIG. 1. The difference in potential level between the development roller 5 and toner supplying member 20 during development was set to 800 V and 20 $\mu$A of electric current was flowed from the development roller 5 to toner supplying member 20. As for the test, a solid in image (solid image which covers the entirety of recording medium) was consecutively printed on 10 printing papers as recording mediums P. Then, the difference in density between the leading and trailing edges of each image, in terms of the direction in which the recording medium P was conveyed, was studied. The results were that no significant difference in density was found between the leading and trailing edge portions in any of 10 copies, and no significant difference in density was found between the first and tenth copies.

Based on the results of Concrete Examples 4–7, the inventors of the present invention determined that the phenomenon that the toner 7 on the development roller 5 was prevented from moving, as well as the phenomenon that the toner 7 on the development roller 5 was stripped from the toner supplying member 20, occurred because the contact pressure between the toner supplying member 20 and development roller 5 was high, Then, they carried out more experiments to further study the effects of the contact pressure, discovering that when the contact pressure (contact pressure per unit of length) between the toner supplying member 20 and development roller 5 is greater than 0.7 N/cm, the toner supplying member 20 strips the toner 7 from the development roller 5 by an amount greater than the amount by which it supplies the development roller 5 with the toner 7. Further, the greater the contact pressure between the toner supplying member 20 and development roller 5, the greater the torque necessary to drive the developing apparatus 4. Therefore, the contact pressure is not desired to be greater than a certain value.

As described above, when placing the toner supplying member 20 in contact with the development roller 5, the contact pressure is desired to be set to no more than 0.7 N/cm, so that while the developing apparatus 4 is in operation, the toner supplying member 20 can be pushed away from the development roller 5 by the toner stream Ft which flows along the peripheral surface of the development roller 5, and that the toner 7 is not prevented from flowing into the area in which the electric field is strongest, and in which the toner 7 is charged by the electric discharge. With the provision of this structural arrangement, even while the developing apparatus 4 is continuously operated, the development roller 5 is supplied with a sufficient amount of the toner 7. Further, for the purpose of assuring that even when the amount of the toner 7 is relative small, and therefore, the toner powder pressure is relatively low in the adjacencies of the toner supplying member 20, the above described toner stream Ft is not blocked, the contact pressure (contact pressure per unit of length) between the toner supplying member 20 and development roller 5 is preferred to be no more than 0.5 N/cm, most preferably, no more than 0.1 N/cm.

On the other hand, when the toner supplying member 20 and development roller 5 are disposed with the presence of a gap between them, the gap is desired to be no more than 0.5 mm. The formation of the toner stream is traceable to the toner movement caused by the rotation of the development roller 5. Therefore, when the distance between the toner supplying member 20 and development roller 5 is no less than 0.5 mm, the toner velocity in the adjacencies of the toner supplying member 20 is substantially smaller than the peripheral velocity of the development roller 5. Therefore, the toner supplying streams F0 and F1 are both lower in velocity. Therefore, it is difficult for the surface layer of the development roller 5 to be supplied with a satisfactory amount of toner. Therefore, it is undesired that the above described distance is no less than 0.5 mm. In other, words, the gap between the toner supplying member 20 and development roller 5 is desired to be no more than 0.3 mm, most preferably, no more than a value which allows the toner supplying member 20 to remain in contact with the development roller 5 when there is no toner between the toner supplying member 20 and development roller 5.

The above described results are summarized in the following Table 1.

TABLE 1

| | WIRE DIA. | POSITION | POTENTIAL DIFF. | TONER SUPPLY |
|---|---|---|---|---|
| EX. 1 | 0.25 mm | SPACED 500 μm | 800 V (20 μA) | GOOD |
| EX.2 | 3 mm | SPACED 200 μm | 1200 V (30 μA) | DENSITY DIFF. |

TABLE 1-continued

| | WIRE DIA. | POSITION | POTENTIAL DIFF. | TONER SUPPLY |
|---|---|---|---|---|
| EX. 3 | 2 mm | SPACED 200 μm | 1200 V (30 μA) | GOOD |
| EX. 4 | 1 mm | CONTACT 1 N/cm | 400 V (20 μA) | LOW DENSITY DENSITY DIFF. |
| EX. 5 | 3 mm | CONTACT 1 N/cm | 0 V | NO |
| EX. 6 | 0.3 mm | CONTACT 1 N/cm | 0 V | NO |
| EX. 7 | 1 mm | CONTACT 0.5 N/cm | 800 V (20 μA) | GOOD |

Figure 19:
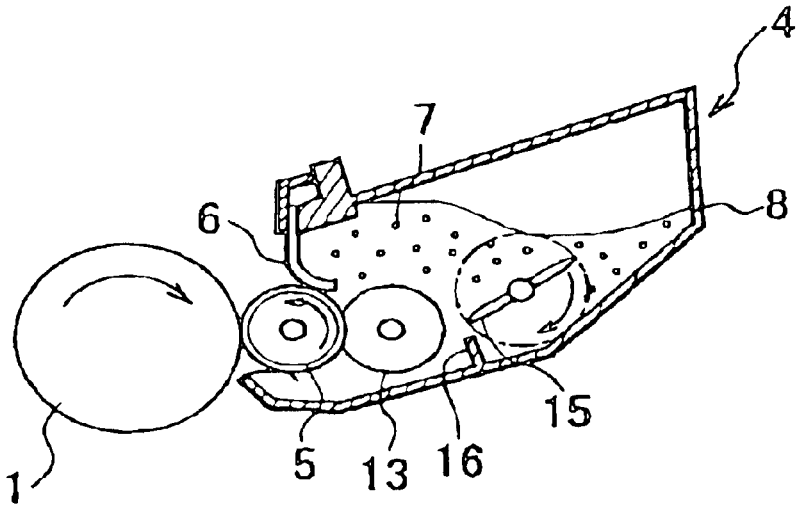
FIG. 19 PRIOR ART
FIG. 19 is a schematic sectional view of an example of a conventional developing device.

Further, the torque necessary for driving the developing apparatus in accordance with the present invention, and the torque necessary for driving a conventional developing apparatus (FIG. 19) which employed a developer stripping/supplying roller 13 as a developer supplying member, were measured. The comparison between the two torques revealed that the torque necessary for driving the developing apparatus in accordance with the present invention was smaller by roughly 30% than the torque necessary for driving a conventional developing apparatus which employed a developer stripping/supplying roller 13. In addition, when the developer container 8 of the developing apparatus 4 in accordance with the present invention, and the developer container 8 of the conventional developing apparatus employing the toner stripping/supplying roller 13, were the same in developer capacity, the former was smaller by 40 $cm^3$ in external size than the latter.

As described above, the present invention makes it possible to cause electric discharge between the toner supplying member 20 and development roller 5, charging thereby the toner stream Ft formed by the rotation of the development roller 5, while creating the toner supplying streams F0 and F1, which are capable of continuously supplying the development roller 5 with the toner 7, by using the electric field generated by the electric discharge. Further, since the toner supplying member 20 is formed of a piece of relatively thin wire, it is relatively small and does not interfere with the flow of the toner stream Ft. Therefore it is possible to provide a toner supplying means which is smaller in the increase in the amount of the load to which the development roller 5 is subjected, and which is smaller in the mount of the torque necessary for driving the development roller 5.

Further, since the diameter of the toner supplying member 20 is no more than 2 mm, it does not prevent a portion of the toner stream F1 from flowing on the opposite side of the toner supplying member 20 with respect to the development roller 5, allowing this portion of the toner stream Ft to turn into the toner supplying stream F1 which increases the amount by which the toner is supplied to the development roller 5.

Further, the toner supplying member 20 is disposed in the adjacencies of the development roller 5, or it is disposed in contact with the development roller 5 with the provision of a contact pressure small enough to allow the toner supplying member 20 to become separated from the development roller 5 as the development roller 5 is driven. Therefore, normally, the toner supplying member 20 does not come into direct contact with the development roller 5 during the operation of the developing apparatus 4, reducing the amount by which the toner on the development roller 5 is stripped by the toner supplying member 20.

Embodiment 2

Next, another embodiment of the present invention will be described. The basis structures and operations of the image forming apparatus and developing apparatus in this embodiment are the same as those in the first embodiment. In other words, this embodiment is different from the first embodiment only in the structure of the toner supplying member. Thus, the components in this embodiment, which are the same in structure and function as those in the first embodiment, are given the same reference characters as those given to the corresponding components in the first embodiment, and will not be described in detail.

This embodiment, which also employs a toner supplying member 20 as a developer supplying member to which voltage is applied, is characterized in that it is superior to the preceding embodiment in the quality of an image formed in an environment in which temperature and humidity are low.

In the first embodiment, the toner supplying member 20 was electrically conductive. However, when a solid image is printed in a low temperature-low humidity environment using an image forming apparatus comprising an electrically conductive toner supplying member (20), the resultant solid image sometimes suffers from a large number of image defects, more specifically, circular spots, which are approximately 0.5–3 mm in diameter, and which are different in density from the surrounding areas.

This image defect seems to occur for the following reason. That is, while the developing apparatus 4 is in operation, vibrations sometimes occur, and also, the development roller 5 and toner supplying member 20 sometimes rub each other. As a result, the gap between the toner supplying member 20 and development roller 5 varies by a minute amount, which in turn locally varies the strength of the discharge current. Consequently, the amount by which toner is supplied to the development roller 5 varies, resulting in the formation of the image suffering from the above described circular spots. This phenomenon is particularly conspicuous in a low temperature-low humidity environment, because electric discharge is unstable in such an environment.

There is a close relationship between the amount of the discharge current and the amount of the toner 7 which is charged; the greater the amount of the discharge current, the greater the toner supplying pressure, and the amount by which the toner is supplied to the development roller 5. Thus, if the amount of the discharge current corresponding to a given area changes, the amount by which toner is supplied to the portion of the development roller 5 corresponding to this area changes, resulting sometimes in the above described image defect.

The inventors of the present invention diligently studied this phenomenon, discovering that this phenomenon could be dealt with by coating the toner supplying member 20 with a substance, the resistivity of which is in the medium range, that is, in the range of $10^4$–$10^{11}$ Ω·cm.

In this embodiment, the toner supplying member 20 was formed of tungsten wire, the cross section of which is roughly in the form of a circle with a diameter of 0.2 mm, and which is coated with a 80 μm thick resistive layer, the resistivity of which was $10^6$ Ω·cm. It was placed in contact with the development roller 5 with the provision of a contact pressure (contact pressure per unit of length) of 0.05 N/cm.

As for developer, nonmagnetic single-component developer (toner 7) was used. The average particle diameter of the toner 7 was 7 μm, and the normal electric charge polarity of the toner 7 was negative. The toner 7 was placed in the developer container 8 by an amount large enough to fill the adjacencies of the toner supplying member 20.

The developing apparatus 4 having the above described developer container 8 was mounted in the image forming apparatus 100 shown in FIG. 1. Then, a solid image (solid black image which covers the entirety of printing paper) was continuously printed on 10 printing papers as recording mediums P using this image forming apparatus 100, in a low temperature-low humidity environment, in which the temperature and humidity were 15° C. and 10% respectively. During the development, the difference in potential between the development roller 5 and toner supplying member 20 was kept at 1,400 V, and 20 μA of electric current was flowed from the development roller 5 to the toner supplying member 20. As a result, the circular spots, that is, the density irregularities traceable to the local (nonuniform) electric discharge between the development roller 5 and toner supplying member 20, did not occur at all; 10 copies with a solid black image uniform in density were consecutively printed.

Figure 13:
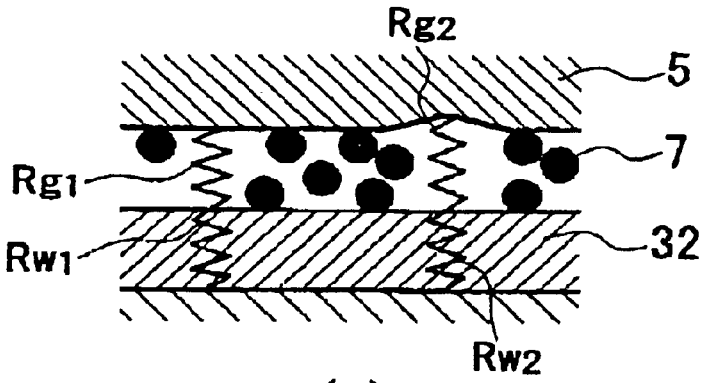
FIG. 13(*a*) is a schematic view of a toner supply member and FIG. 13(*b*) is an equivalent circuit diagram, which illustrate a developing device using a toner supply member having an intermediate resistance layer.
Figure 13:
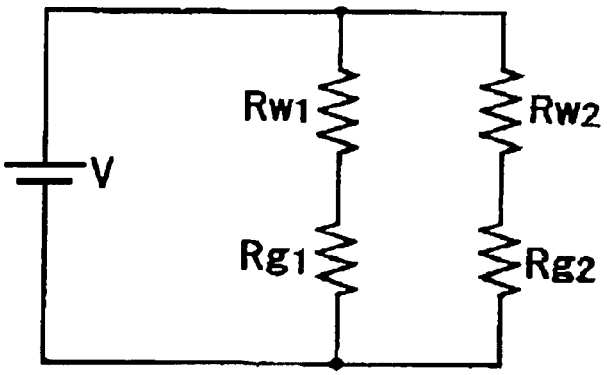

FIG. 13(*a*) schematically shows the adjacencies of the toner supplying member 20 in this embodiment. As is evident from the drawing, the toner supplying member 20 in this embodiment is given a surface layer 32 of a substance, the electrical resistance of which is in the medium range. As the development roller 5 is rotationally driven, with the adjacencies of the toner supplying member 20 filled with the toner 7, the toner 7 enters between the development roller 5 and toner supplying member 20, forcing the toner supplying member 20 to be kept a certain distance away from the development roller 5.

When discharge current is flowing between the development roller 5 and toner supplying member 20, this distance (gap) between the development roller 5 and toner supplying member 20 may be presumed to provide a certain amount of electrical resistance. Therefore, in terms of electrical characteristics, the adjacencies of the toner supplying member 20 shown in FIG. 13(*a*) can be represented by the equivalent circuit given in FIG. 13(*b*). In the drawings, alphanumeric terms Rg1 and Rg2 represent the amounts of electric resistance of randomly selected two locations in the gap, and alphanumeric terms Rw1 and Rw2 represent the amounts of electrical resistance of the portions of the medium resistance layer 32 of the toner supplying member 20 corresponding to the above described randomly selected two locations in the gap. To calculate the ratio of the amount of the electric current I1 which flows through the gap (resistance Rg1), relative to the amount of the electric current I2 (resistance Rg2), based on this equivalent circuit:

$$I1/I2=(Rw2+Rg2)/(Rw1+Rg1).$$

The amounts of the electrical resistance Rg1 and Rg2 are affected by the minute irregularities of the surface of the development roller 5 and minute displacement of the toner supplying member 20. Further, as the temperature and humidity decrease, the values of Rg1 and Rg2 increase, which is thought to affect the stability (instability) of the discharge current significantly more than the minute irregularities of the development roller 5 surface and minute displacement of the toner supplying member 20. When the material of the toner supplying member 20 is electrically conductive wire, the amounts of the electrical resistance Rw1 and Rw2 may be assumed to be zero. Thus, the discharge current ratio I1/I2 is Rg2/Rg1. Therefore, the amount of the discharge current between the development roller 5 and toner supplying member 20 is affected substantially more by the distances (gap) (amounts of resistance Rg1 and Rg2) between the development roller 5 and toner supplying member 20 than the other factors. As a result, the amount of the discharge current locally fluctuates in a low temperature-low humidity environment.

In comparison, the toner supplying member 20 in this embodiment is provided with a surface layer 32, the electrical resistance of which is in the medium range. Therefore, the amount of the discharge current is prevented from fluctuating, if it is assumed:

$$Rw1, Rw2 >> Rg1, Rg2,$$

Then,

I1/I2 nearly equals Rw2/Rw2. Thus, if Rw1=Rw2, I1/I2 nearly equals 1.

Thus, increasing the resistance value of the surface layer 32 contributes to the stabilization of the discharge current.

However, increasing the electrical resistance of the surface layer 32 to a level higher than a certain value abolishes the premise of Rw1=Rw2, making thereby the discharge current easily susceptible to the instability of the electrical resistance of the surface layer 32, and the irregularities in the thickness of the surface layer 32. Consequently, the discharge current between the development roller 5 and toner supplying member 20 becomes unstable due to the instability on the toner supplying member 20 side. In addition, in order to flow the same amount of the discharge current, it is necessary to increase the amount of the voltage applied to the toner supplying member 20, which is not desired.

Thus, the inventors of the present invention diligently studied the above described problem, making the following discoveries. That is, the volume resistivity of the surface layer 32 with which the toner supplying member 20 is provided is desired to be in the range of $10^4$–$10^{11}$ Ω·cm, and preferably, the product of the volume resistivity and thickness of the surface layer 32 is in the range of $10^3$–$10^{10}$ Ω·cm$^2$. Further, most preferably, the gap and the medium resistance surface layer 32, are roughly the same in electrical resistance, and therefore, the product of the volume resistivity and thickness of the surface layer 32 is desired to be roughly in the range of $10^7$–$10^9$ Ω·cm$^2$.

If the volume resistivity of the medium resistance surface layer 32 is no more than the above described range, for example, $10^3$ Ω·cm, and the toner supplying member 20 and development roller 5 partially contact each other due to the vibrations caused by the driving of the development roller 5, electric current leaks through the contact areas; electric current flows by an amount much larger than the normal amount of the discharge current. Consequently, an image suffering from a large number of circular spots, which are 0.5–3 mm in diameter, and which are different in density from the surrounding areas, are formed due to the instability in the amount of the discharge current. This phenomenon is particularly conspicuous in the above described low temperature-low humidity environment. On the other hand, if the volume resistivity of the medium resistance surface layer 32 is no less than the above described range, for example, $10^{12}$ Ω·cm, the effect of the irregularities of the resistive layer resulting from the coating error is greater, resulting in the formation of an image suffering from streaks, the cause of which is traceable to the local irregularities of the resistive layer. Further, the instability in the amount of the discharge current caused by the unevenness in the thickness of the resistive layer is conspicuous. Moreover, there is the problem that in order to keep the amount of the discharge current at the same level, the voltage applied to the toner supplying member 20 must be increased. The above described assessments were made based on the results of the following test. That is, the toner supplying member 20 was formed of a piece of tungsten wire, the cross section of which was in the form of a circle with a diameter of 0.25 mm, and was provided with an 80 μm thick layer 32, the electrical resistance of which was in the medium range. It was placed in contact with the development roller 5 with the provision of a contact pressure (contact pressure per unit of length) of 0.05 N/cm. As for developer, nonmagnetic single-component developer (toner 7) was used. The average particle diameter of the toner 7 was 7 μm, and the normal electric charge polarity was negative. The toner 7 was placed in the developer container 8 by an amount large enough to fill the adjacencies of the toner supplying member 20. The developing apparatus 4 having the above described developer container 8 was mounted in the image forming apparatus 100. Then, a solid image was continuously printed on 10 printing papers as recording mediums P using this image forming apparatus 100, in a low temperature-low humidity environment, in which the temperature and humidity were 15° C. and 10%, respectively. Then, the resultant images were visually evaluated.

As for the thickness of the surface layer 32 of the toner supplying member 20, the electrical resistivity of which is in the medium range, if it is too thin, the electric discharge between the development roller 5 and toner supplying member 20 becomes unstable due to the defects, such as pinholes, of the surface layer 32 itself, or the wear of the surface layer 32 resulting from the friction from the toner. Thus, it is desired to be no less than 10 μm. Increasing the thickness of the medium resistance surface layer 32 reduces the probability of the presence of pinholes, makes the layer 32 less likely to wear out, and also improves the layer 32 in terms of the stability in electrical resistance, which is desirable. However, the maximum limit of the thickness of the medium resistance surface layer 32 of the toner supplying member 20 is determined by the maximum overall diameter of the toner supplying member 20, and is desired to be no more than 1 mm.

Incidentally, if the toner supplying member 20 is formed of electrically conductive wire, and is not provided with the medium resistance surface layer 32, the toner 7 is locally welded to the toner supplying member 20 by the heat generated by the local electric discharge, which results in the formation of a streaky image. This problem can be prevented by providing the toner supplying member 20 with the medium resistance surface layer 32 as is the toner supplying member 20 in this embodiment, since the provision of the medium resistance layer 32 stabilizes the discharge current, which in turn prevents the toner solidification, that is, the welding of the toner to the toner supplying member 20.

In conclusion, according to this embodiment of the present invention, the possibility that an image suffering from the defect resulting from the instability in the amount by which toner is supplied to the development roller 5 will be formed in a low temperature-low humidity environment can be minimized. Therefore, the toner delivery to the development roller 5 remains stable in a wide range of environmental conditions.

Embodiment 3

Next, another embodiment of the present invention will be described. The basic structures and operations of the image forming apparatus and developing apparatus in this embodiment are the same as those in the first embodiment. In other words, this embodiment is different from the first embodiment, only in the structure of the toner supplying member. Thus, the components in this embodiment, which are the same in structure and function as those in the first embodiment, are given the same reference characters as those given to the corresponding components in the first embodiment, and will not be described in detail.

Also in this embodiment, the toner supplying member 20 is given the surface layer of a certain substance. More specifically, when toner with the negative normal electrical polarity is used as developer, the toner supplying member 20 is given the surface layer of a substance with the positive normal electrical polarity, whereas when toner with the positive normal electrical polarity is used as developer, the toner supplying member 20 is given the surface layer of a substance with the negative normal electrical polarity. Thus, toner is charged to its normal electrical polarity by the friction between the toner and surface layer of the toner supplying member 20, whereas the surface layer of the toner supplying member 20 is charged to the electrical polarity opposite to the normal electrical polarity of the toner. In other words, the toner supplying member 20 and toner 7 charge each other by friction. As a result, the toner is attached to the peripheral surface of the surface layer of the toner supplying, member 20, evenly coating the peripheral surface. This layer of toner 7 adsorbed on the peripheral surface of the surface layer of the toner supplying member 20 functions as a buffer layer, weakening the effect of the displacement of the toner supplying member 20 relative to the development roller 5. Therefore, the electric discharge between the development roller 5 and toner supplying member 20 is stabilized, With the presence of this buffer layer, even if the material for the surface layer is low in electrical resistance, the electrical discharge remains stable.

In this embodiment, the toner supplying member 20 was formed of tungsten wire, the cross section of which is roughly in the form of a circle with a diameter of 0.25 mm, and which was given a 10 $\mu$m thick urethane layer with a resistivity of $10^2$ Ω·cm It was placed in contact with the development roller 5 with the provision of a contact pressure (contact pressure per unit of length) of 0.05 N/cm.

As for developer, nonmagnetic single-component toner 7 was used. The average particle diameter of the toner 7 was 7 $\mu$m, and the normal electric charge polarity of the toner was negative. The toner 7 was placed in the developer container 8 by an amount large enough to fill the adjacencies of the toner supplying member 20.

The developing apparatus 4 having the above described developer container 8 was mounted in the image forming apparatus 100 shown in FIG. 1. While the developing apparatus 4 was in operation, the difference in potential between the development roller 5 and toner supplying member 20 was kept at 900 V, and 20 $\mu$A of electric current was flowed from the development roller 5 to the toner supplying member 20. Then, a solid image (solid image which covers the entirety of printing paper) was continuously painted on 10 printing papers as recording mediums P using this image forming apparatus 100, in a low temperature-low humidity environment, in which the temperature and humidity were 15° C. and 10%, respectively. As a result, the circular spots, that is, the density irregularities, did not occur at all; 10 copies with a solid image uniform in density were is consecutively printed.

As the material for the surface layer of the toner supplying member 20, the normal electrical polarity of which is positive, there are urethane, nylon, phenol resin, etc., for example. As for the material for the surface layer or the toner supplying member 20, the normal electrical polarity of which is negative, there are fluorinated resin, such as PFA, PTFE, FEP, etc., for example. Further, a substance or substances capable of providing electrical conductivity may be mixed into these materials. Needless to say, the material for the surface layer of the toner supplying member 20 is not limited to those listed above.

In this embodiment, the toner supplying member 20 is given the above described surface layer in order to minimize the possibility that when an image forming apparatus comprising the developing apparatus having the toner supplying member 20 is used in the above described low temperature-low humidity environment, an image suffering from a large number of circular spots, that is, density irregularities, which are 0.5–3 mm in diameter, and the cause of which is traceable to the unstable electric discharge, will be formed. Therefore, the resistivity of the material for the surface layer of the toner supplying member 20 is desired to be no less than $10^2$ Ω·cm. Further, irregularities in the resistive layer resulting from coating errors result in the formation of images suffering from density irregularities in the form of streaks. Therefore, the resistivity of the material for the surface layer of the toner supplying member 20 is desired to be no more than $10^{11}$ Ω·cm, preferably, in the range of $10^3$–$10^{10}$ Ω·cm, most preferably, in the range of $10^5$–$10^9$ Ω·cm, which is close to the apparent resistivity range of the aforementioned gap between the development roller 5 and toner supplying member 20.

In conclusion, according to this embodiment of the present invention, a buffer layer for minimizing the effect of the fluctuation of the distance between the development roller 5 and toner supplying member 20 is formed on the peripheral surface of the toner supplying member 20 by attracting the toner to the surface of the toner supplying member 20. Therefore, it is assured that a distance equivalent to the sum of the diameters of several toner particles is maintained between the development roller 5 and toner supplying member 20. Therefore, the electric discharge between the development roller 5 and toner supplying member 20 remains stable, making it possible for toner to be continuously supplied to the development roller 5 by a satisfactory amount.

Embodiment 4

Next, another example of an image forming apparatus to compatible with the developing apparatus in accordance with the present invention will be described. The image forming apparatus in this embodiment is a process cartridge type laser beam printer, in which a process cartridge is removably mountable, and which is capable of forming an image on recording medium, for example recording paper, OHP sheet, fabric, etc., with the use of an electrophotographic method, in response to the image formation information from an external host apparatus connected to the main assembly of the image forming apparatus so that communication is possible between the image forming apparatus and host apparatus.

Figure 14:
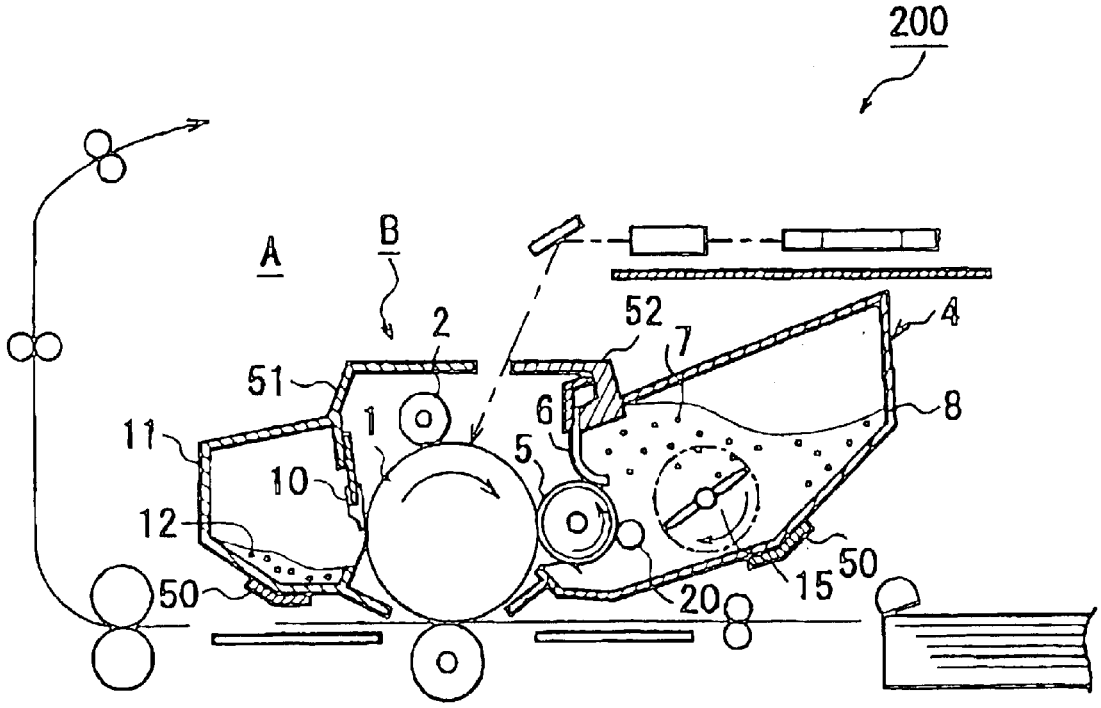
FIG. 14 is a schematic sectional view of an image forming apparatus according to another embodiment of the present invention.
Figure 15:
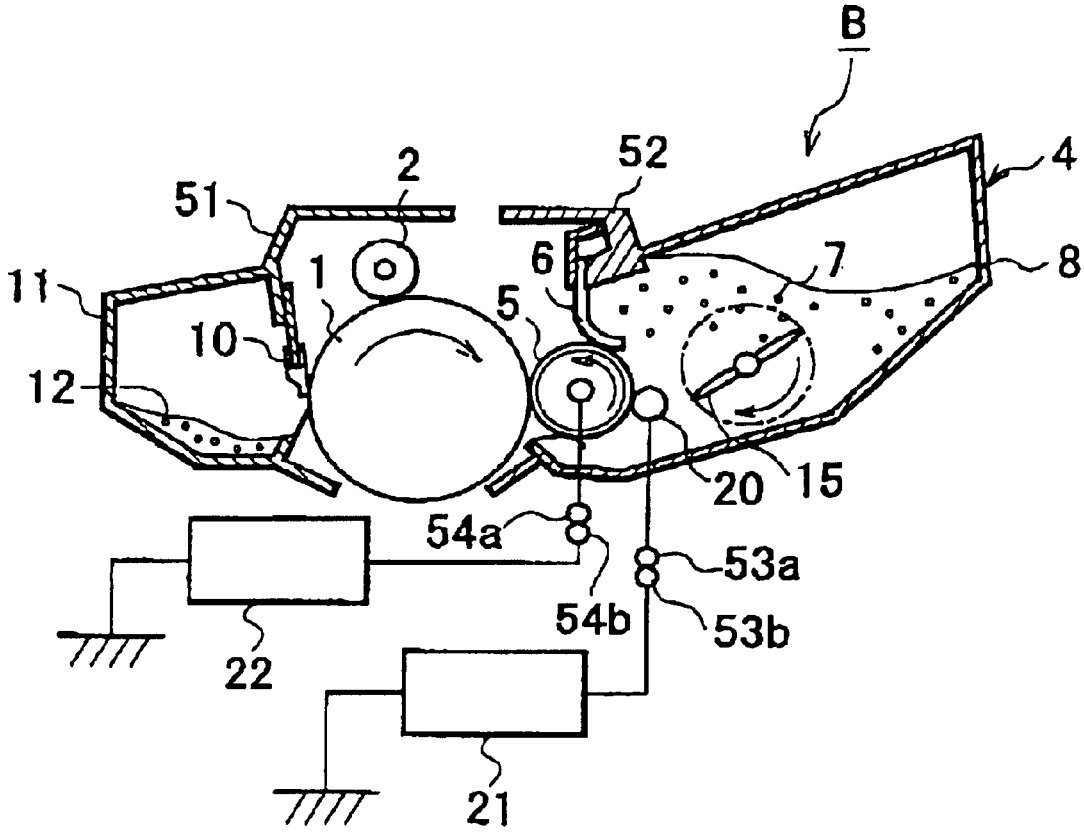
FIG. 15 is a schematic sectional view of a process cartridge according to an embodiment of the present invention.

FIG. 14 is a schematic sectional view of the image forming apparatus 200 in this embodiment, and FIG. 15 is a schematic sectional view of the process cartridge B in this embodiment. The image forming apparatus 200 in this embodiment is the same in basic structure and operation as the image forming apparatuses in the preceding embodiments, except that this image forming apparatus is of a process cartridge type, and therefore, a process cartridge is removably mountable in the main assembly of the image forming apparatus. Thus, the components or portions of this apparatus, which are similar in structure and operation to those of the image forming apparatuses in the preceding embodiments, are given the same reference characters as those given to the corresponding components or portions of the image forming apparatuses in the preceding embodiments, and their detailed descriptions will not be given.

The process cartridge B in this embodiment comprises a cleaner frame 51 and a development frame 52, which are integrated. It is removably mountable in the main assembly A of the image forming apparatus. The cleaner frame 51 comprises a waste toner container 11 for storing the waste toner 12. The cleaner frame 51 doubles as a supporting member for supporting a cleaning blade 10, a charge roller 2, and a photoconductive drum 1. The development frame 52 is provided with a developer container 8 filled with the toner 7, and doubles as the supporting member for supporting a regulating blade 6, a development roller 5, and toner supplying member 20. In other words, the development frame 52 is equivalent to the developing apparatuses 4 in the first to fifth embodiments. The developing apparatus 4 of the process cartridge B in this embodiment is the same as those in the preceding embodiments described above.

The process cartridge B is removably mounted in the main assembly A of the image forming apparatus, by being assisted by the mounting means 50 of the apparatus main assembly A.

The cleaner frame 51 and development frame 52 are connected to each other so that they are positioned in a predetermined relationship in the process cartridge B, causing the photoconductive drum 1 and development roller 5 to be kept in contact with each other in a manner to generate a predetermined amount of contact pressure. As the process cartridge B is properly positioned in the apparatus main assembly A, the driving means of the apparatus main assembly A meshes with the drum gear (unshown) of the photoconductive drum for transmitting driving force to the photoconductive drum 1, making it possible for the photoconductive drum 1 to be driven. The drum gear is in mesh with the development roller gear (unshown) for transmitting driving force to the development roller 5. Thus, the photoconductive drum 1 and development roller 5 arc rotationally driven at a predetermined peripheral velocity.

The process cartridge B is provided with an electrical contact 53*a* for supplying the toner supplying member 20 with electric power, and the apparatus main assembly A is provided with an electrical contact 53*b* for supplying the toner supplying member 20 with electric power. As the process cartridge B is mounted into the apparatus main assembly A, the electrical contact 53*a* is connected to the electrical contact 53*b* in electrical terms, making it possible to apply toner supplying bias to the toner supplying member 20 of the developing apparatus 4 in the process cartridge B, through the electrical contacts 53*a* and 53*b*, from a power source 21, on the apparatus main assembly A side, for supplying the toner supplying bias. Similarly, as the process cartridge B is mounted into the apparatus main assembly A, the development bias contact 54*a* on the process cartridge B side, comes into contact with the development bias contact 54*b* on the apparatus main assembly A side, making it possible to apply the development bias to the development roller 5 of the developing apparatus 4 in the process cartridge B, through the bias contacts 54*a* and 54*b*, from the development bias power source 22 on the apparatus main assembly A side.

As described above, the image forming apparatus in this embodiment employs a process cartridge system, that is, a system in which processing means are integrally disposed in a cartridge removably mountable in the main assembly A of an image forming apparatus. Therefore, as the image forming apparatus runs out of the toner 7; the service life of the photoconductive drum 1 expires; the waste toner container 11 is filled up with the recovered toner 12, etc., a user can maintain the image forming apparatus without relying on a service person, drastically improving the apparatus in operational efficiency.

Incidentally, the process cartridge in this embodiment comprises: an electrophotographic photoconductive member; a combination of charging means, developing means, and cleaning means, as processing means which act on the electrophotographic photoconductive member; and a cartridge in which the preceding components are integrally disposed, and which is removably mountable in the main assembly of the image forming apparatus. However, process cartridge configuration does not need to be limited to that of the process cartridge in this embodiment. For example, the process cartridge may comprise: an electrophotographic photoconductive member; a minimum of one among the charging means, developing means, and cleaning means, as processing means which acts on the electrophotographic photoconductive member; and a cartridge in which the preceding components are integrally disposed, and which is removably mountable in the main assembly or the image forming apparatus, or may comprise: a minimum of a combination of an electrophotographic photoconductive member, and a developing apparatus comprising a developer container for holding developer, a developer bearing member for conveying the developer in the developer container to the object to be developed, and a developer supplying member; and a cartridge in which the preceding components are integrally disposed, and which is removably mountable in the main assembly of the image forming apparatus. As long as a process cartridge is configured as described above, it can be used with the image forming apparatus in this embodiment, with preferable results.

As described above, the toner supplying member 20 employed in the process cartridge B in this embodiment is designed to disturb, as little as possible, the toner stream created by the rotation of the development roller 5, so that while the developing apparatus 4 is in operation, the toner supplying stream is created on the downstream side of the toner supplying member 20, by a part of the above described tuner stream, which flows over the toner supplying member 20, and the electric field generated by the voltage applied to the toner supplying member 20.

For the purpose of preventing the above described toner supplying stream from being disturbed, it is desired that there is nothing but toner in the adjacencies of the toner supplying stream. In other words, the presence of no member which is in contact with, or in the adjacencies of, the development roller 5, on the downstream side of the toner supplying member 20 and at the same, on the upstream side of the regulating blade 6, in terms of the rotational direction of the development roller 5, is effective to continuously supply the development roller 5 with a satisfactory amount of toner. The analyses by the inventors of the present invention revealed that the portion of the toner stream, which is no less than roughly 1 mm away from the portion of the developer bearing area of the development roller 5 negligibly contributes to the process of supplying toner to the development roller 5. Therefore, it is desired that no member is present within one millimeter of the development roller 5.

As described above, the development roller 5 is supplied with toner by the toner supplying member 20, and immediately thereafter, the layer of the toner on the peripheral surface of the development roller 5 is regulated in thickness by the regulating blade 6 located on the downstream side of the toner supplying member 20 in terms of the moving direction of the peripheral surface of the development roller 5. Thereafter, the thickness regulated portion of the layer of the toner on the peripheral surface of the development roller 5 moves out of the developer container 8. Therefore, the development roller 5 is continuously supplied with a satisfactory amount of toner, as described above.

Figure 16:
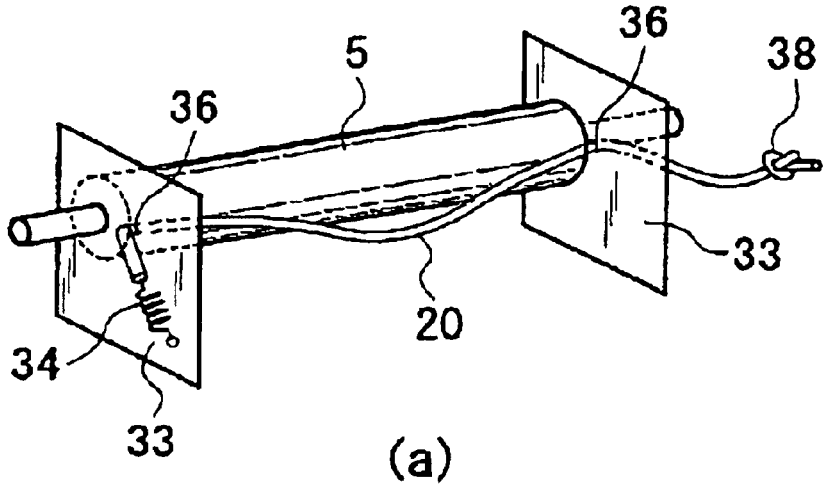
FIGS. 16(*a*) and 16(*b*) are perspective views illustrating a fixing method of a toner supply member according to an embodiment of the present invention.
Figure 16:
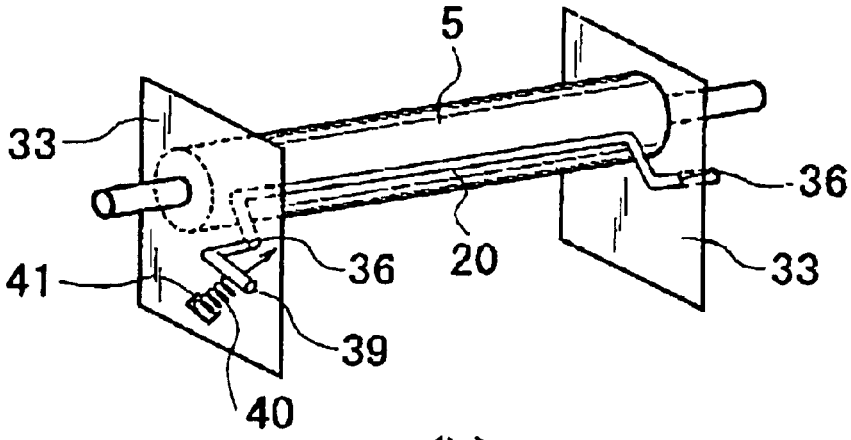

For the above described reason, the toner supplying member 20 is desired to be solidly fixed so that it does not interfere with the toner circulation in the developer container 8. FIG. 16 shows the adjacencies of the portions to which the toner supplying member 20 is solidly fixed.

FIG. 16(*a*) represents a case in which a piece of wire, which is relatively low in rigidity, and the diameter (external diameter) of which is no more than 0.5 mm, is used as the material for the toner supplying member 20. In this case, the metallic core, as a supporting shaft, of the development roller is supported by the pair of side plates 33 of the developer container 8. Each side plate 33 is provided with a hole 36, and the toner supplying member 20 is put through this hole 36. The hole 36 is positioned in such a positional relationship, relative to the hole for supporting the metallic core of the development roller 5, that as the toner supplying member 20 is tensioned, it is placed in contact with, or very close to, the development roller 5 as described above.

One end of the toner supplying member 20 is provided with a means for preventing the toner supplying member 20 from slipping through the hole 36 of the side plate 33 as the toner supplying member 20 is pulled inward of the side plate 33 to tension the toner supplying member 20; for example, it is provided with a knot 38. Obviously, the means for preventing the toner supplying member 20 from becoming disengaged does not need to be the knot 38. For example, an object capable of preventing the end portion of the toner supplying member 20 from slipping through may be glued or welded to one end of the toner supplying member 20.

The other end of the toner supplying member 20 is connected to the free end of a tension spring 34, the other end of which is anchored to the side plate 33. Thus, the toner supplying member 20 is tensioned by the tension spring 34, being therefore disposed roughly in parallel to the development roller With the provision of the above described structural arrangement, the toner supplying member 20 is disposed very close to, or in contact with, the development roller 5 while minimizing the effect of the toner supplying member 20 upon the toner circulation in the developer container 8.

In comparison, FIG. 16(*b*) represents a case in which the toner supplying member 20 is formed of a piece of strong metallic wire, the diameter of which is relatively large, that is, large enough to provide the toner supplying member 20 a rigidity high enough to prevent the toner supplying member 20 from deforming while being supported at its lengthwise ends. Also in this case, the shaft of the development roller 5 is supported by the pair of side plates 33 of the developer container 8. Each side plate 33 is provided with a through hole 36 through which the toner supplying member 20 is put. The toner supplying member 20 is supported by the wall of each hole 36, being made rotatable. More specifically, the toner supplying member 20 is bent roughly in the form of a crankshaft, making the center portion of the toner supplying member 20, roughly parallel to the development roller 5, offset from the line connecting the centers of the holes 36 and 36 of the pair of the side plates 33 and 33, one for one, of the developer container 8.

One of the side plates 33 is provided with a spring mount 41, to which one end of the compression spring 40 is anchored. The free end of the compression spring 40 is placed in contact with the pressure catching portion 39 of the end portion of the toner supplying member 20, pressuring the pressure catching portion 39 of the toner supplying member 20 in the direction indicated by an arrow mark in the drawing. The direction of this pressure is offset from the hole 36 with respect to the plane of the side plate 33. Therefore, this pressure acts in a manner to rotate the toner supplying member 20 about the line connecting the centers of the holes 36 and 36, keeping thereby the center portion of the toner supplying member 20, roughly parallel to the development roller 5, pressed upon the development roller 5.

The strength of the compression spring 40 is set to generate a contact pressure (pressure per unit of length) of 0.7 N/cm between the toner supplying member 20 and development roller 5 so that while the developing apparatus 4 is in operation, the toner supplying member 20 is kept away from the development roller 5 by the toner stream.

With the provision of the above described structural arrangement, the toner supplying member 20 is placed in contact with the development roller 5, with the generation of a predetermined contact pressure between the toner supplying member 20 and development roller 5, or in the immediate adjacencies of the development roller 5, while minimizing the effect of the presence of the toner supplying member 20 upon the toner circulation in the developer container 8.

Further, the torque necessary for driving the developing apparatus of the process cartridge B in this embodiment, and the torque necessary for driving a conventional developing apparatus (FIG. 19) which employed a developer stripping/supplying roller 13 as a developer supplying member, were measured. The comparison between the two torques revealed that the process cartridge B in this embodiment is roughly 30% smaller in the torque necessary for driving the developing apparatus than the conventional process cartridge 13 which employed a developer stripping/supplying roller 13. In addition, when the developer container 8 of the developing apparatus 4 in accordance with the present invention, and the developer container 8 of the conventional developing apparatus employing the toner stripping/supplying roller 13, were the same in developer capacity, the former was smaller by 40 $cm^3$ in external size than the latter.

Incidentally, the method used to attach the toner supplying member 20 in this embodiment is also applicable to the developing apparatuses 4 in the preceding embodiments, which are not incorporated in a process cartridge.

In conclusion, the above described method used to attach the toner supplying member 20 does not interfere with the toner stream Ft generated by the toner supplying method in accordance with the present invention, allowing the toner stream Ft to create the toner supplying streams F0 and F1 which flow to the regulating blade 6, stabilizing the toner supplying process.

Miscellaneous Embodiments

Up to this point, the toner supplying member 20, the material for the core of which is tungsten wire, was described. However, the core material for the toner supplying member 20 does not need to be limited to tungsten wire.

That is, as long as a material is electrically conductive, the other properties thereof do not need to be questioned. The wire diameter (external diameter) of the toner supplying member 20 has only to be large enough to provide the toner supplying member 20 with mechanical strength large enough for the toner supplying member 20 to withstand the friction against toner. For example, when the material for the toner supplying member 20 is metallic wire, its diameter is desired to be no less than 100 $\mu$m, so that the toner supplying member 20 does not break even if it is subjected to a tension of roughly 1 N/cm.

Figure 17:
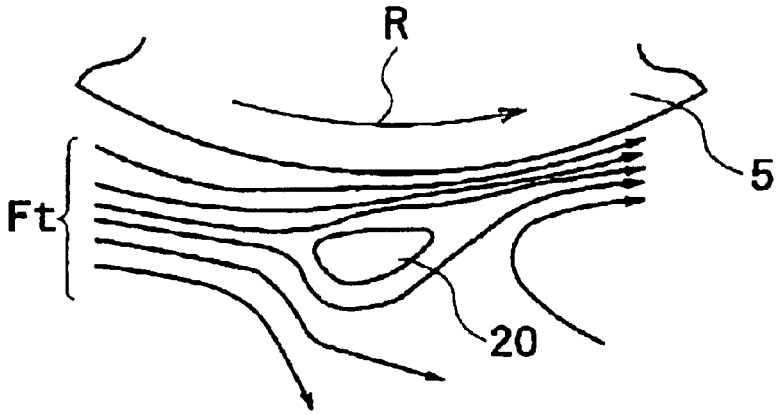
FIG. 17 is a schematic sectional view of a toner supply member according to a further embodiment of the present invention.

The shape of the cross section of the toner supplying member 20 does not need to be limited to a circle. For example, it may be streamlined as shown in FIG. 17. Making the cross section of the toner supplying member 20 streamlined makes the toner supplying member 20 less likely to disturb the toner stream. Therefore it may be expected that making the cross section of the toner supplying member 20 streamlined will improve the effectiveness of the toner supplying member 20 in supplying the development roller 5 with toner. Obviously, the cross section of the toner supplying member 20 may be in the form other is than a circle or a streamlined shape. However, for the purpose of preventing the toner stream from being disturbed, the cross section of the toner supplying member 20 is desired to be shaped so that the toner supplying member 20 has as small a number of the sharply angled portions as possible, and also so that the contour of the cross section of the toner supplying member 20 is curved. When the cross section of the toner supplying member 20 is not circular, the wire diameter of the toner supplying member 20 is defined as the width of the projection of the toner supplying member 20 in the direction of the toner current, and it is desired to be in the above described range.

The preceding embodiments of the present invention were described with reference to developing apparatuses 4 having a single toner supplying member 20. However, the application of the present invention is not limited to these developing apparatuses 4. In other words, a developing apparatus may be provided with two or more toner supplying members 20. The provision of two or more toner supplying members 20 increases the amount by which toner is supplied to the development roller 5 per unit of time, making possible to deal with a high speed developing apparatus 4.

The developing member (developer bearing member) with which the developing apparatus 4 is provided does not need to be limited to the elastic rollers in the preceding embodiments, in other words, the configuration of a developing member is optional as long as the surface layer of the developing member, which faces the toner supplying member 20, is not insulating, that is, it is electrically conductive to some degree. As for the resistivity of the developing member, as long as it is in the range of $10^2$–$10^{10}$ Ω·cm, it does not create a problem when embodying the present invention. Further, the developing member may be in the form of a tube or a belt. Further, the surface layer of the developing member may be formed of hard phenol resin or the like.

Further, the preceding embodiments of the present invention were described with reference to developing apparatuses 4 which used nonmagnetic single-component toner as developer. However, the application of the present invention is not limited to these developing apparatuses 4. In other words, as long as a developer is chargeable to a given polarity, and its electrical resistance is relatively high, the other properties thereof do not need to be questioned. As for the resistivity of a developer, as long as it is no less than $10^{10}$ Ω·cm, it does not create a problem when embodying the present invention. For example, the present invention is also applicable to a developing apparatus which employs a magnetic developer, and such an application produces the same effects as those described above.

Figure 18:
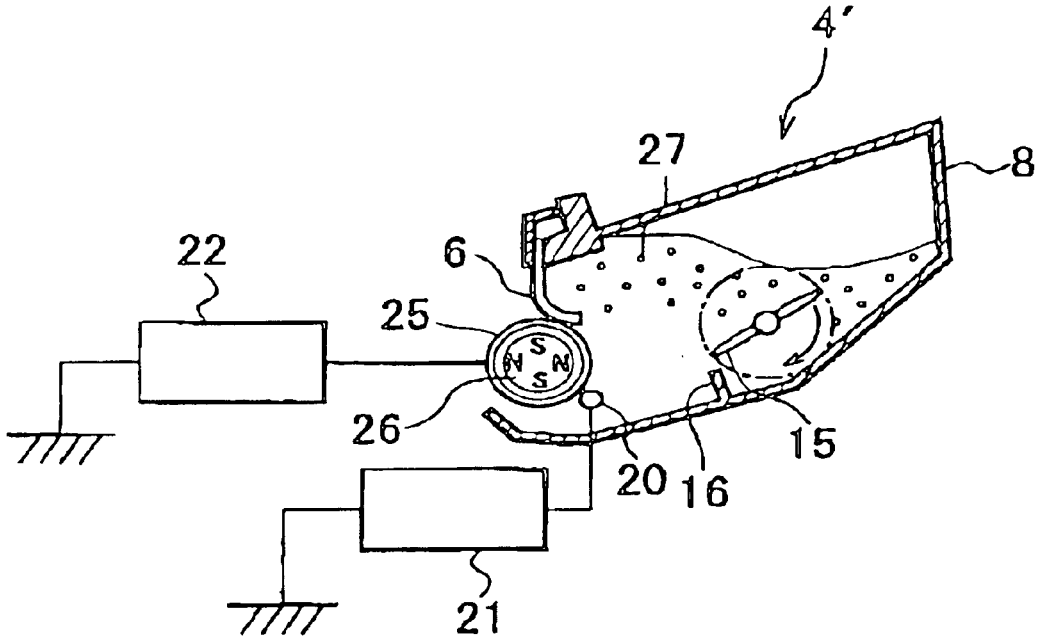
FIG. 18 is a schematic sectional view of a developing device according to a further embodiment of the present invention.

FIG. 18 is schematic sectional view of the developing apparatus 4' in accordance with the present invention, which uses a magnetic single-component developer (toner) 27 as developer. The developing apparatus 4' has a development sleeve 25, which is a piece of hollow pipe made of nonmagnetic metal. Within the hollow of the development sleeve 25, a magnet 26, in the form of a circular pillar, is stationarily disposed as a magnetic field generating means. When the developing apparatus 4' is in operation, the development sleeve 25 is rotated around the magnet 26, and as the development sleeve 25 is rotated, the toner 27 is supplied to the development sleeve 25 by being attracted thereto by the magnetic force of the magnet 26.

If the external diameter of the development sleeve 25 is made relatively small, for example, no more than 12 mm, the magnet 26, which is to be disposed within the development sleeve 25, must also be made small, making it difficult for the magnet 26 to generate a sufficient amount of magnetic force. Thus, when the reduction of the size of the magnet 6 makes it impossible to generate a sufficient amount of magnetic force for toner delivery, it is possible to employ a toner supplying member similar to the toner supplying members 20 in the preceding embodiments, along with the above described toner developer supplying method in accordance with the present invention, in addition to the magnet 26. With the provision of this structural arrangement, not only is it possible to assure that the development roller 5 is continuously supplied with a proper amount of developer, but also it is possible to reduce developing apparatus size beyond the conventional limit.

Further, the preceding embodiments of the present invention were described with reference to the image forming apparatus having a single developing apparatus. However, the present invention is also applicable to an electrophotographic image forming apparatus having a plurality of electrophotographic image forming stations, a plurality of developing apparatuses, or a plurality of process cartridges, and such applications produce the same effects as those described above.

The present invention is also applicable to a cartridge (development cartridge) in which only a developing apparatus is disposed, and which is removably mountable in the main assembly of an image forming apparatus. In this case, the development cartridge is removably mounted into the main assembly of the image forming apparatus, by being assisted by the cartridge mounting means with which the apparatus main assembly is provided. The process cartridge in this case may be thought to be virtually the same as the process cartridge B in the above described fourth embodiment, minus the cleaning frame 51.

As for examples of a patent application, preceding the present invention, in which a toner supplying member in the form of wire is placed in a developing apparatus, there are Japanese Laid-open Patent Applications 56-123573, 56-123574, and 6-51623. Japanese Laid-open Patent Applications 56-123573 and 56-123574 disclose a developing apparatus in which a member formed of a piece of wire is used to magnetically or mechanically disturb a magnetic brush, whereas Japanese Laid-open Patent Application 6-51623 discloses a developing apparatus in which the toner on a development roller being supplied with AC voltage is mechanically stripped by a member formed of a piece of wire and placed in contact with the development roller, or by the electrically generated vibrations. However, the knowledge obtained by the inventors of the present invention through diligent studies, that is, the knowledge regarding the toner supplying effect of the electric discharge which occurs between the member formed of a piece of wire and the development roller, through the toner in the adjacencies of the member formed of wire, the knowledge regarding the toner current created in the adjacencies of the member formed of wire, or the knowledge regarding the toner supplying effect of the toner supplying toner stream, is not such knowledge that can be inferred from the above listed patent applications.

As described above, the present invention makes it possible to eliminate a conventional developer supplying roller which needs to be rotationally driven, making it possible to reduce the torque necessary to driving a driving apparatus. Further, the present invention makes it possible to reduce the size of a developer supplying member compared to the size of a conventional developer supplying roller, making it possible to reduce apparatus size. As is evident from the above description of the present invention, the present invention makes it possible to provide a developing apparatus, a process cartridge, and an image forming apparatus, which are smaller in the torque necessary to drive them, simple in structure, smaller in size, and lower in cost.

While the invention has been described with reference to the structures disclosed herein, it is riot confined to the details set forth, and this application is intended to cover such modifications or changes as may come within the purposes of the improvements or the scope of the following claims.

What is claimed is:

1. A developing apparatus comprising:

a developer carrying member for carrying a developer; and a developer feeding member, disposed close to or in contact to said developer carrying member, for supplying a developer to said developer carrying member, said developer feeding member being in the form of a wire and is adapted to be supplied with a voltage which is effective to electrically charge the developer to a regular polarity and which is higher than a discharge starting voltage at which electric discharge starts between said developer carrying member and said developer feeding member.

2. An apparatus according to claim 1, wherein a diameter of said developer feeding member is not more than 2 mm.

3. An apparatus according to claim 1, wherein a distance between said developer feeding member and said developer carrying member is not more than 0.5 mm.

4. An apparatus according to claim 1, wherein said developer feeding member is contacted to said developer carrying member in a state in which said developer carrying member is not driven, and the developer is not present.

5. An apparatus according to claim 4, wherein a contact line pressure of said developer feeding member to said developer carrying member is not more than 0.7 N/cm.

6. An apparatus according to claim 1, wherein said developer feeding member has an electrode and a surface layer provided at a surface of said developer feeding member and having a volume resistivity between $10^4$–$10^{11}$ Ωcm.

7. An apparatus according to claim 1, wherein said developer feeding member includes an electrode and a surface layer on a surface of said developer feeding member, said surface layer having a triboelectric charge polarity which is opposite a regular charge polarity of the developer.

8. An apparatus according to claim 1, wherein said developing device further comprises a developing container, and said developer carrying member is disposed at an opening of said developing container.

9. An apparatus according to claim 8, wherein said developer carrying member is effective to develop an electrostatic image formed on said image bearing member with a developer at the opening.

10. An apparatus according to claim 1, further comprising a regulating member for regulating a thickness of a layer of the developer carried on said developer carrying member, wherein said developer feeding member is disposed downstream of a developing position of said developer carrying member and upstream of a developer regulating position of said regulating member with respect to a developer feeding direction of said developer carrying member.

11. An apparatus according to claim 10, wherein said regulating member is a first member that is contacted to said developer carrying member or that is spaced by not more than 1 mm from said developer carrying member, toward downstream from said developer supply member with respect to the developer feeding direction of said developer carrying member.

12. An apparatus according to claim 1, wherein said voltage is a DC voltage.

13. An apparatus according to claim 1, wherein said developing apparatus is provided together with an image bearing member in a process cartridge detachably mountable to a main assembly of an image forming apparatus.

* * * * *

UNITED STATES PATENT AND TRADEMARK OFFICE

CERTIFICATE OF CORRECTION

PATENT NO. : 6,871,035 B2
DATED : March 22, 2005
INVENTOR(S) : Ken Nakagawa

It is certified that error appears in the above-identified patent and that said Letters Patent is hereby corrected as shown below:

Title page,
Item [57], ABSTRACT,
Line 9, “starling” should read -- starting --.

Column 1,
Line 44, “difficulty.” should read -- difficult. --; and
Line 59, “of” should read -- on --.

Column 2,
Line 53, “during” should read -- driving --.

Column 24,
Line 48, “to” should be deleted.

Column 25,
Line 44, “ave” should read -- are --.

Column 31,
Line 29, “riot” should read -- not --.

Signed and Sealed this

Sixteenth Day of August, 2005

JON W. DUDAS
*Director of the United States Patent and Trademark Office*